US008843049B2

(12) United States Patent
Kabata et al.

(10) Patent No.: US 8,843,049 B2
(45) Date of Patent: Sep. 23, 2014

(54) ELECTROPHOTOGRAPHIC IMAGE FORMING METHOD

(71) Applicants: Toshiyuki Kabata, Kanagawa (JP); Momoko Shionoiri, Kanagawa (JP); Masato Iio, Kanagawa (JP); Tsuyoshi Asami, Kanagawa (JP)

(72) Inventors: Toshiyuki Kabata, Kanagawa (JP); Momoko Shionoiri, Kanagawa (JP); Masato Iio, Kanagawa (JP); Tsuyoshi Asami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 17 days.

(21) Appl. No.: 13/681,845

(22) Filed: Nov. 20, 2012

(65) Prior Publication Data

US 2013/0188972 A1 Jul. 25, 2013

(30) Foreign Application Priority Data

Jan. 24, 2012 (JP) ..... 2012-012291

(51) Int. Cl.

| | |
|---|---|
| ***G03G 15/20*** | (2006.01) |
| ***G03G 15/00*** | (2006.01) |
| ***G03G 8/00*** | (2006.01) |
| ***G03G 13/22*** | (2006.01) |
| ***G03G 9/09*** | (2006.01) |
| ***B41M 7/00*** | (2006.01) |

(52) U.S. Cl.

CPC ..... *B41M 7/0045* (2013.01); *G03G 15/6585* (2013.01); *G03G 8/00* (2013.01); *G03G 13/22* (2013.01); *G03G 9/09* (2013.01)

USPC ..... 399/341; 399/342; 399/325; 399/340

(58) Field of Classification Search

CPC ..... G03G 15/6585; G03G 5/14721; G03G 9/133; G03G 9/1331

USPC ..... 399/15, 320, 325, 326, 341, 342

See application file for complete search history.

(56) References Cited

U.S. PATENT DOCUMENTS 7,060,349 B2 * 6/2006 Tamemasa et al. ..... 428/319.1
7,151,238 B2 * 12/2006 Kama ..... 219/400

(Continued)

FOREIGN PATENT DOCUMENTS

JP 1-163747 6/1989
JP 10-309876 11/1998

(Continued)

OTHER PUBLICATIONS

Takashi Ito, Introduction of JIS X 6933 & ISO/IEC 15775-compliant Color Test Chart of Copying Machine of ISO/IEC JTC1/SC28, p. 11.*

(Continued)

*Primary Examiner* — Clayton E Laballe
*Assistant Examiner* — Ruifeng Pu
(74) *Attorney, Agent, or Firm* — Oblon, Spivak, McClelland, Maier & Neustadt, L.L.P.

(57) ABSTRACT

An image forming method including forming an image of a toner including a wax on a recording medium; fixing the toner image using by an oil-less fixing device; and then forming an overcoat layer on the fixed toner image. When a portion of the fixed toner image having the heaviest toner weight is subjected to an ATR FT-IR analysis, a peak area ratio Ab/Aa falls in a range of 3.0 to 7.0 or a peak area ratio Ab'/Aa' falls in a range of 0.004 to 0.014, wherein Aa represents the area of a peak present in a range of 2896 $cm^{-1}$ to 2943 $cm^{-1}$, Ab represents the area of a peak present in a range of 2946 $cm^{-1}$ to 2979 $cm^{-1}$, Aa' represents the area of a peak present in a range of 791 $cm^{-1}$ to 860 $cm^{-1}$, and Ab' represents the area of a peak present in a range of 2834 $cm^{-1}$ to 2862 $cm^{-1}$.

5 Claims, 8 Drawing Sheets

(56) References Cited

U.S. PATENT DOCUMENTS

| | | | | |
|---|---|---|---|---|
| 7,205,046 | B2 * | 4/2007 | Kobayashi et al. | 428/343 |
| 2010/0196062 | A1 | 8/2010 | Kozasa et al. | |
| 2011/0052928 | A1 | 3/2011 | Shionoiri et al. | |
| 2011/0135361 | A1 | 6/2011 | Kabata et al. | |
| 2011/0223527 | A1 * | 9/2011 | Iio et al. | 430/105 |
| 2012/0243890 | A1 | 9/2012 | Iio et al. | |

FOREIGN PATENT DOCUMENTS

| | | |
|---|---|---|
| JP | 2007-277547 | 10/2007 |
| JP | 2012-078565 | 4/2012 |
| JP | 2012-181314 | 9/2012 |
| JP | 2012-181315 | 9/2012 |
| JP | 2012-198468 | 10/2012 |

OTHER PUBLICATIONS

Program and Abstracts: ISO-tests charts for daily Application in Image Technology, p. 3.*

U.S. Appl. No. 13/489,629, filed Jun. 6, 2012, Toshiyuki Kabata, et al.

* cited by examiner

ELECTROPHOTOGRAPHIC IMAGE FORMING METHOD

CROSS-REFERENCE TO RELATED APPLICATIONS

This patent application is based on and claims priority pursuant to 35 U.S.C. §119 to Japanese Patent Application No. 2012-012291 filed on Jan. 24, 2012 in the Japan Patent Office, the entire disclosure of which is hereby incorporated by reference herein.

FIELD OF THE INVENTION

The present invention relates to an electrophotographic image forming method including forming a toner image using a toner including a wax; fixing the toner image on a recording medium using an oil-less fixing device which does not apply a release agent to a fixing member; and then forming an overcoat layer on the fixed toner image.

BACKGROUND OF THE INVENTION

Conventionally, techniques such that an overcoat layer is formed on the surface of an image on a ticket, a catalogue or a color page of a magazine using a varnish to impart expensive-looking to the image have been used. Particularly, in mercantile field, such a layer is typically formed on a large number of images formed by printing such as screen printing. Although these images typically have high image area ratios, the images having such a layer are clear and have expensive looking because the applied varnish has good compatibility with inks used for screen printing.

Recently there is a need for frequently changing or updating information to be printed. Since screen printing performs printing after preparing an original plate, screen printing cannot fulfill the need because a profit is hardly produced thereby. Therefore, so-called on-demand printing has been performed therefor.

Devices using electrophotography and inkjet recording methods are typically used for on-demand printing. Since it takes time before drying an ink image formed by inkjet recording, it is difficult for inkjet recording to quickly produce a large number of images although inkjet recording can be used for producing a small number of images. In addition, when an ink image is formed on a paper sheet and then dried, the paper sheet is typically expanded and then contracted, and the thickness of some parts of the paper slightly changes, thereby causing a stacking problem in that prints cannot be stacked orderly. Therefore, electrophotographic image forming methods using toner are mainly used for on-demand printing now. Electrophotographic image forming methods typically include charging a photoreceptor; irradiating the charged photoreceptor to form an electrostatic latent image thereon; developing the electrostatic latent image with toner to form a toner image on the photoreceptor; transferring the toner image onto a recording medium such as paper sheets; and fixing the toner image to the recording medium upon application of heat thereto.

In attempting to form such an overcoat layer as mentioned above in electrophotographic image forming methods, a technique is proposed which uses an aqueous overcoat layer composition liquid, which includes water as a main component without including ammonia and which has a low static surface tension, for forming an overcoat layer on images on which an oil used is applied by a fixing member in a fixing process.

In addition, a resin layer forming device, and an image forming apparatus equipped with the resin layer forming device are proposed which form a silicone resin layer is formed on a recorded image to protect the image while waterproofing and glossing the image.

Further, in attempting to efficiently perform high-mix low-volume printing using electrophotographic image forming methods, a printing method in which a varnish is applied on a toner image formed on a metal container to protect the toner image while glossing the image is proposed.

These methods are preferable when forming an overcoat layer on an image formed by electrophotography.

In fixing devices of conventional electrophotographic image forming apparatuses, a large amount of silicone oil is applied on the surface of a fixing roller to improve the releasability of the fixing roller from a toner image on a recording medium. However, the releasability of a surface portion of a fixing roller coated with a silicone oil is largely different from that of a surface portion of the fixing roller which is not coated with the silicone oil, and if the fixing roller has a surface portion which is not coated with the silicone oil, an image having uneven glossiness (i.e., an image having linear non-glossy portions) is formed. If such images are formed in commercial printing, the percentage of defective prints seriously increases, thereby increasing the manufacturing costs. In addition, when such a silicone oil is adhered to a floor, the floor becomes very slithery, and in addition it is difficult to perfectly remove the silicone oil adhered to the floor. Therefore, when such a silicone oil is supplied to a fixing device or a maintenance operation is performed on the fixing device, the person in charge has to perform the supplying operation and the maintenance operation with extreme caution. Therefore, the persons in charge dislike the operations terribly.

Recently, instead of such fixing methods using a silicone oil, image forming methods using a so-called oil-less fixing method have been used. In such image forming methods, a toner including a wax is used for forming a toner image, and when the toner image is fixed by a fixing roller upon application of heat thereto, the wax is exuded from the toner to improve the releasability of the toner image from the fixing roller.

In such oil-less fixing, the more the amount of wax present between a fixing roller and a toner image, the better the releasability of the fixing roller from the toner image. Therefore, a wax having a low melting point is typically added to the toner while increasing the added amount of the wax as much as possible, and the fixing conditions such as pressure of the fixing roller, fixing temperature, and fixing time are properly adjusted so that the wax in the toner is easily exuded therefrom in the fixing process.

When an overcoat layer is formed on an image subjected to such oil-less fixing, the following problems (1) and (2) tend to be caused:

(1) The wax present on the image repels a coating liquid including the overcoat layer composition, and therefore the overcoat layer becomes very thin on the image area.

(2) The adhesiveness of the overcoat layer, which is crosslinked, with the image deteriorates, thereby causing a problem in that when the image area is rubbed or bent, the overcoat layer is released from the image.

For these reasons, the inventors recognized that there is a need for an image forming method which includes forming an overcoat layer on a toner image fixed by oil-less fixing and which can produce a clear image having expensive-looking and good rub-resistance.

BRIEF SUMMARY OF THE INVENTION

As an aspect of the present invention, an image forming method is provided which includes forming an image of a toner including a wax on a recording medium using electrophotography; fixing the toner image using an oil-less fixing device which fixes the toner image using a fixing member without applying a release agent to the fixing member; and then forming an overcoat layer on the toner image.

When a portion of the toner image having the heaviest toner weight in the fixed toner image is subjected to an ATR FT-IR (Attenuated Total Reflectance Fourier Transform Infrared Spectroscopy) analysis under the below-mentioned conditions to obtain a spectrum of the portion of the fixed toner image, the following relationship (1) or (2) is satisfied:

| | |
|---|---|
| $3.0 \leq Ab/Aa \leq 7.0$ | (1), or |
| $0.004 \leq Ab'/Aa' \leq 0.014$ | (2), |

wherein Aa represents the area of a peak of the spectrum present in a range of from 2896 $cm^{-1}$ to 2943 $cm^{-1}$, Ab represents the area of a peak present in a range of from 2946 $cm^{-1}$ to 2979 $cm^{-1}$, Aa' represents the area of a peak present in a range of from 791 $cm^{-1}$ to 860 $cm^{-1}$, and Ab' represents the area of a peak present in a range of from 2834 $cm^{-1}$ to 2862 $cm^{-1}$.

The ATR FT-IR conditions are as follows.

Crystal used: Ge

Incident angle: 45°

Number of reflectance: one

The area Aa of the peak in the range of from 2896 $cm^{-1}$ to 2943 $cm^{-1}$ is defined as the area of a portion of the peak above a base line, which is a line connecting a point of the peak at 2896 $cm^{-1}$ with a point of the peak at 2943 $cm^{-1}$.

The area Ab of the peak in the range of from 2946 $cm^{-1}$ to 2979 $cm^{-1}$ is defined as the area of a portion of the peak above a base line base, which is a line connecting a point of the peak at 2946 $cm^{-1}$ with a point of the peak at 2979 $cm^{-1}$.

The area Aa' of the peak in the range of from 791 $cm^{-1}$ to 860 $cm^{-1}$ is defined as the area of a portion of the peak above a base line base, which is a line connecting a point of the peak at 791 $cm^{-1}$ with a point of the peak at 860 $cm^{-1}$.

The area Ab' of the peak in the range of from 2834 $cm^{-1}$ to 2862 $cm^{-1}$ is defined as the area of a portion of the peak above a base line, which is a line connecting a point of the peak at 2834 $cm^{-1}$ with a point of the peak at 2862 $cm^{-1}$.

The aforementioned and other aspects, features and advantages will become apparent upon consideration of the following description of the preferred embodiments taken in conjunction with the accompanying drawings.

DETAILED DESCRIPTION OF THE INVENTION

Figure 1:
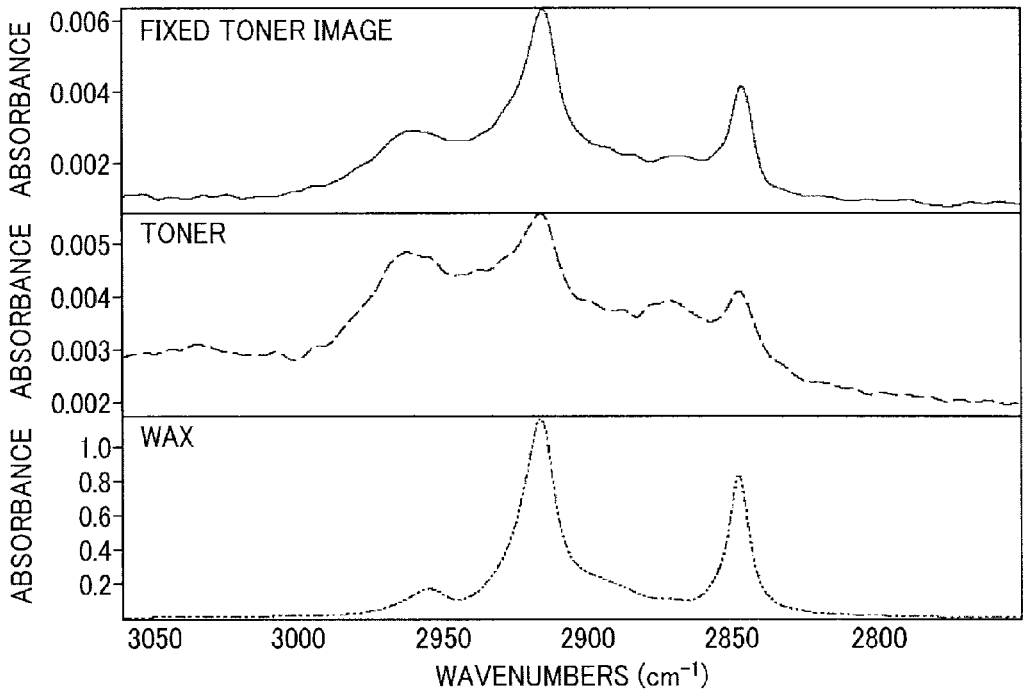
FIG. 1 illustrates ATR FT-IR spectra of a first toner image fixed by oil-less fixing, a toner used for forming the first toner image, and a wax included in the toner.

The image forming method of the present invention includes forming an image of a toner including a wax on a recording medium using electrophotography; fixing the toner image using an oil-less fixing device which fixes the toner image without applying a release agent to a fixing member; and then forming an overcoat layer on the toner image.

When a portion of the toner image having the heaviest toner weight in the toner image is subjected to an ATR FT-IR (Attenuated Total Reflectance Fourier Transform Infrared Spectroscopy) analysis, the following relationship (1) or (2) is satisfied:

| | |
|---|---|
| $3.0 \leq Ab/Aa \leq 7.0$ | (1), or |
| $0.004 \leq Ab'/Aa' \leq 0.014$ | (2), |

wherein Aa represents the area of a peak present in a range of from 2896 $cm^{-1}$ to 2943 $cm^{-1}$, Ab represents the area of a peak present in a range of from 2946 $cm^{-1}$ to 2979 $cm^{-1}$, Aa' represents the area of a peak present in a range of from 791 $cm^{-1}$ to 860 $cm^{-1}$, and Ab' represents the area of a peak present in a range of from 2834 $cm^{-1}$ to 2862 $cm^{-1}$.

The ATR FT-IR conditions are as follows.

Crystal used: Ge

Incident angle: 45°

Number of reflectance: one

The area Aa of the peak in the range of from 2896 $cm^{-1}$ to 2943 $cm^{-1}$ is defined as the area of a portion of the peak above a base line, which is a line connecting a point of the peak at 2896 $cm^{-1}$ with a point of the peak at 2943 $cm^{-1}$.

The area Ab of the peak in the range of from 2946 $cm^{-1}$ to 2979 $cm^{-1}$ is defined as the area of a portion of the peak above a base line, which is a line connecting a point of the peak at 2946 $cm^{-1}$ with a point of the peak at 2979 $cm^{-1}$.

The area Aa' of the peak in the range of from 791 $cm^{-1}$ to 860 $cm^{-1}$ is defined as the area of a portion of the peak above a base line, which is a line connecting a point of the peak at 791 $cm^{-1}$ with a point of the peak at 860 $cm^{-1}$.

The area Ab' of the peak in the range of from 2834 $cm^{-1}$ to 2862 $cm^{-1}$ is defined as the area of a portion of the peak above a base line, which is a line connecting a point of the peak at 2834 $cm^{-1}$ with a point of the peak at 2862 $cm^{-1}$.

The image forming method of the present invention will be described in detail.

Initially, our study of adhesiveness between toner images subjected to oil-less fixing and overcoat layers formed thereon using ATR FT-IR will be described in detail.

The present inventors have studied why an overcoat layer composition liquid tends to be repelled by toner images subjected to oil-less fixing. As a result, the present inventors discovered that repelling is different depending on portions of toner images, and repelling is greatest on a solid toner image having a large area. In addition, when cross-sections of solid toner images were observed using an electron microscope, it was found that a wax included in the toner covers substantially the entire surfaces of the solid images.

Further, it was found that among portions of an overcoat layer formed on the entire surface of a recording medium sheet having a toner image including a solid toner image, a portion of the overcoat layer formed on the toner image tends to be easily released therefrom, and a portion of the overcoat layer formed on the solid toner image is released therefrom most easily.

When the present inventors observed an interface between an overcoat layer and a solid toner image subjected to oil-less fixing, it was found that the interface has a portion in which a wax is present between the overcoat layer and the solid toner image, and the overcoat layer is slightly separated from the solid toner image (i.e., separated from the wax layer on the solid toner image).

It is found from the study that when a wax layer having a large area is present on a toner image subjected to oil-less fixing, adhesion between the toner image and the overcoat layer formed on the toner image is inhibited. Namely, it is found that an overcoat layer having good rub resistance can be formed only on a toner image which is subjected to oil-less fixing and on which a wax is not present or is present in a small amount.

The present inventors have studied the method of determining whether a toner image subjected to oil-less fixing has a property such that an overcoat layer can be satisfactorily formed thereon while paying attention to analyzing the surface of a toner image using ATR FT-IR. As a result, it was found that whether a toner image subjected to oil-less fixing has such a property can be determined based on a ratio Ab/Aa, wherein Aa represents the area of a peak of the IR spectrum of the toner image present in a range of from 2896 to 2943 $cm^{-1}$, and Ab represents the area of a peak of the IR spectrum of the toner image present in a range of from 2946 to 2979 $cm^{-1}$. Thus, the present invention has been made.

FIG. 1 illustrates ATR FT-IR spectra of a toner image fixed by oil-less fixing and having good adhesiveness with on overcoat layer, a toner used for forming the toner image, and a wax included in the toner. In this regard, the ATR FT-IR analysis is performed under the conditions such that the crystal used for ATR FT-IR is Ge, the incident angle is 45, and reflection is made once.

Referring to FIG. 1, each of the spectra of the toner and the wax has both a peak present in a range of from 2896 to 2943 $cm^{-1}$, and a peak present in a range of from 2946 to 2979 $cm^{-1}$. However, the peak of the wax in the range of from 2896 to 2943 $cm^{-1}$ is very high and the peak of the wax in the range of from 2946 to 2979 $cm^{-1}$ is very low. In contrast, the peak of the toner in the range of from 2896 to 2943 $cm^{-1}$ is not very high compared to the peak thereof in the range of from 2946 to 2979 $cm^{-1}$.

Figure 2:
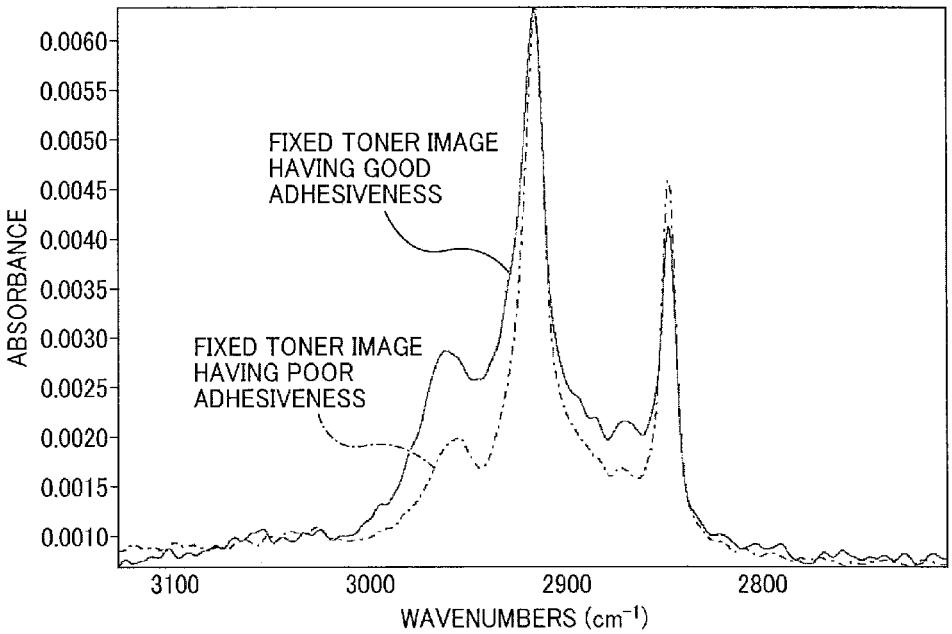
FIG. 2 illustrates ATR FT-IR spectra of a second toner image fixed by oil-less fixing and having good adhesiveness with an overcoat layer, and a third toner image fixed by oil-less fixing and having poor adhesiveness with the overcoat layer.

FIG. 2 illustrates ATR FT-IR spectra of a solid toner image of a toner image fixed by oil-less fixing and having good adhesiveness with an overcoat layer, and another solid toner image fixed by oil-less fixing and having poor adhesiveness with the overcoat layer. It is clear from FIG. 2 that the peak of the solid image having poor adhesiveness in the range of from 2896 to 2943 $cm^{-1}$ is relatively high compared to the peak thereof in the range of from 2946 to 2979 $cm^{-1}$.

Thus, when the area of a peak of the IR spectrum of a toner image present in the range of from 2896 to 2943 $cm^{-1}$ is Aa, and the area of a peak of the IR spectrum of the toner image present in the range of from 2946 to 2979 $cm^{-1}$ is Ab, the ratio Ab/Aa is an index of the amount of the wax present on the toner image. The ratio Ab/Aa is preferably from 3.0 to 7.0, and more preferably from 3.3 to 6.6. In this regard, the more the ratio Ab/Aa, the larger the amount of the wax present on the toner image. From the viewpoint of releasability of toner images in oil-less fixing, the more the ratio Ab/Aa, the better the releasability. However, when the ratio Ab/Aa is greater than 7.0, the adhesiveness between the toner image fixed by oil-less fixing and an overcoat layer deteriorates, thereby causing a problem in that even when the overcoat layer is rubbed lightly, the overcoat layer is released from the toner image. In contrast, when the ratio Ab/Aa is less than 3.0, the releasability of a fixing roller from the toner image deteriorates, thereby causing a problem in that high quality images cannot be produced.

In addition, in order to find a method of determining whether a toner image subjected to oil-less fixing has a property such that an overcoat layer can be satisfactorily formed thereon, the surface of the toner image fixed by oil-less fixing, the toner used for forming the toner image, and the wax included in the toner were analyzed using ATR FT-IR under the conditions such that the crystal used for ATR FT-IR is Ge, the incident angle is 45, and reflection is made once. As a result of analysis of the IR spectra, it was found that the peak of the spectrum of the toner image in the range of from 2834 to 2862 $cm^{-1}$, which is a main peak of the wax, is very low in the spectrum of the toner.

Figure 3:
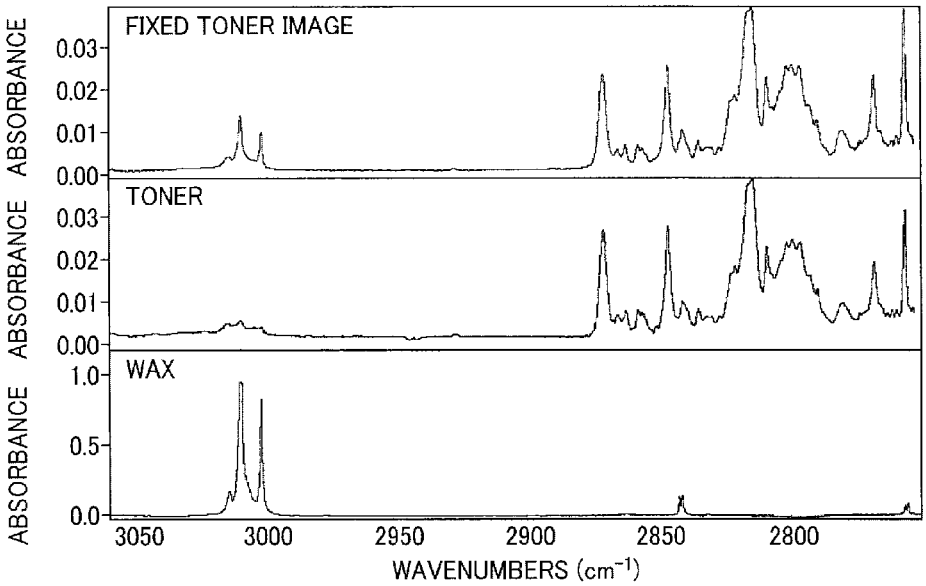
FIG. 3 illustrates ATR FT-IR spectra of a fourth toner image fixed by oil-less fixing, a toner used for forming the fourth toner image, and a wax included in the toner.

FIG. 3 illustrates ATR FT-IR spectra of another toner image fixed by oil-less fixing, the toner used for forming the toner image, and the wax included in the toner. In this regard, the ATR FT-IR analysis is performed under the conditions such that the crystal used for ATR FT-IR is Ge, the incident angle is 45, and reflection is made once.

In the ATR FT-IR, Ge, which has a high refractive index, is adhered to a sample, and then measurement is performed using an evanescent wave. Therefore, the measurement region (depth) of samples (i.e., toner image, toner and wax in this case) is different depending on the wave number. Specifically, as the wave number increases, the measurement depth decreases, and as the wave number decreases, the measurement depth increases.

It is found from FIG. 3 that since the spectrum of the fixed toner image is similar to that of the toner at the low wave number side, the wax is uniformly dispersed in the toner, but is eccentrically present on the surface of the fixed toner image. Therefore, by normalizing the peak in the range of from 2834 to 2862 $cm^{-1}$, the amount of the wax present on the surface of the fixed toner image can be determined.

Any peaks at the low wave number side can be used for normalizing the peak in the range of from 2834 to 2862 $cm^{-1}$. However, the amounts of external additives (such as silica, titanium oxide, and metal soaps) included in the toner are often different from the amounts thereof in the fixed toner image depending on the conditions of the image forming members (such as photoreceptor, charging roller, and cleaning blade) of the image forming apparatus used. Therefore, it is not preferable to normalize the peak in the range of from 2834 to 2862 $cm^{-1}$ using a peak in the vicinity of the peaks of such external additives. The peak in the range of from 791 to 860 $cm^{-1}$ is a peak specific to a polyester resin, which is typically used as a binder resin of toner, and is different from the peaks of such external additives as mentioned above. In addition, the peak in the range of from 791 to 860 $cm^{-1}$ is obtained by measuring a sample from the surface thereof to a deep portion thereof. Therefore, it is preferable to use the peak in the range of from 791 to 860 $cm^{-1}$ for normalizing the peak in the range of from 2834 to 2862 $cm^{-1}$. Thus, the present inventors discovered the method of determining whether a toner image subjected to oil-less fixing has a property such that an overcoat layer can be satisfactorily formed thereon based on these knowledges, thereby making the present invention.

Figure 4:
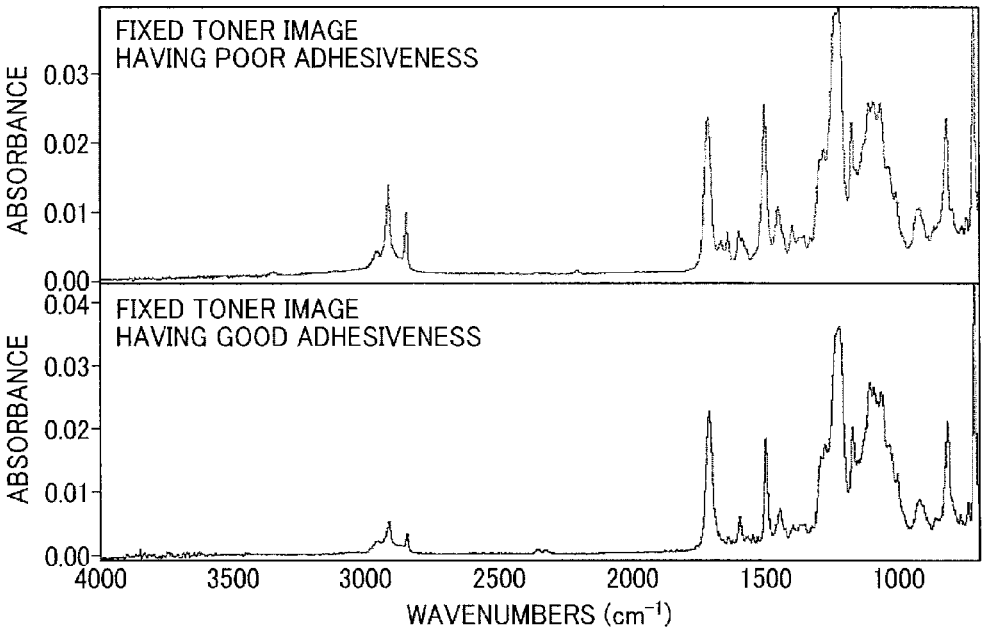
FIG. 4 illustrates ATR FT-IR spectra of a fifth toner image fixed by oil-less fixing and having good adhesiveness with an overcoat layer, and a sixth toner image fixed by oil-less fixing and having poor adhesiveness with the overcoat layer.

FIG. 4 illustrates ATR FT-IR spectra of a solid toner image fixed by oil-less fixing and having good adhesiveness with an overcoat layer, and a solid toner image fixed by oil-less fixing and having poor adhesiveness with the overcoat layer. It is clear from FIG. 4 that the peak in the range of from 2834 to 2862 $cm^{-1}$ of the toner image having poor adhesiveness with the overcoat layer is relatively high compared to the peak in the range of the toner image having good adhesiveness with the overcoat layer.

The ratio Ab'/Aa' of the area (Ab') of the peak in the range of from 2834 to 2862 $cm^{-1}$ to the area (Aa') of the peak in the range of from 791 to 860 $cm^{-1}$ is an index of the amount of a wax present on the surface of a toner image, and is preferably from 0.040 to 0.0140, and more preferably from 0.0045 to 0.0120. In this regard, the more the ratio Ab'/Aa', the larger the amount of the wax present on the surface of the toner image. From the viewpoint of releasability in oil-less fixing, the more the ratio Ab'/Aa', the better the releasability. However, when the ratio Ab'/Aa' is greater than 0.0140, the adhesiveness between the toner image fixed by oil-less fixing and an overcoat layer deteriorates, thereby causing a problem in that even when the overcoat layer is rubbed lightly, the overcoat layer is released from the toner image. In contrast, when the ratio Ab'/Aa' is less than 0.0040, the releasability of a fixing roller from the toner image deteriorates, thereby causing a problem in that high quality images cannot be produced.

The reason why the ratios Ab/Aa and Ab'/Aa' of a portion of a fixed toner image having the heaviest weight is measured is as follows.

Specifically, a wax, which is present between an overcoat layer and a fixed toner image and which deteriorates the adhesiveness therebetween, is supplied only from the toner constituting the toner image, and therefore a portion of the toner image having the heaviest weight includes the wax in the largest amount. Namely, the portion is a solid image.

In general, black, magenta, cyan and yellow toners are used for electrophotographic color image forming methods, and various color images are produced by using the four color toners. Among various solid color images, red, blue and green toner images consist of two color toner images. Therefore, the weight of the red, blue and green toner images are heaviest, and the amount of the wax included in the red, blue and green toner images is largest.

In the image forming method of the present invention, an image of a test chart No. 4 of ISO/IEC 15775:1999 is formed using oil-less fixing, and the ratios Ab/Aa and Ab'/Aa' of highest density portions of the red, blue and green toner images are determined. In this regard, when the highest value among the three ratios Ab/Aa of the red, blue and green toner images is from 3.0 to 7.0, or the highest value among the three ratios Ab'/Aa' of the red, blue and green toner images is from 0.0040 to 0.0140, images having expensive-looking and good adhesiveness with an overcoat layer can be produced on the basis of toner images fixed by oil-less fixing.

The ratios Ab/Aa and Ab'/Aa' of portions of images fixed by oil-less fixing change depending on the amount of a wax included in the toner used, the distribution state of the wax in the toner, and the kinds of the wax. Specifically, the smaller the amount of wax in the toner, the smaller the ratios Ab/Aa and Ab'/Aa'. In addition, the more the amount of wax in a surface portion, the greater the ratios. Further, the lower the melting point of the toner or the higher the fluidity of the toner, the greater the ratios.

In addition, the ratios Ab/Aa and Ab'/Aa' change depending on the weight of the toner image, and the lighter the weight of the toner image, the smaller the ratios. When an overcoat layer is formed on a toner image, the surface of the toner image with the overcoat layer is flat, and therefore the image looks denser than the image without the overcoat layer. Therefore, even when a toner image is formed of a relatively small amount of toner, a high density image can be produced by forming an overcoat layer thereon. In this case, the ratios Ab/Aa and Ab'/Aa' can be decreased.

In addition, the ratios Ab/Aa and Ab'/Aa' change depending on the fixing conditions. Specifically, as the fixing temperature increases, the heating time (i.e., the time of a toner image contacted with a fixing member) increases, or the pressure of a fixing roller increases, a larger amount of wax, which is included in the toner image, exudes from the toner image, thereby increasing the ratios Ab/Aa and Ab'/Aa' of the fixed toner image fixed by oil-less fixing.

Thus, the ratios Ab/Aa and Ab'/Aa' change depending on various factors. However, if the conditions of the factors are substantially constant, the ratios Ab/Aa and Ab'/Aa' can be substantially fixed, thereby making it possible to produce images with an overcoat layer, which have expensive-looking and high durability.

As mentioned above, in the image forming method of the present invention, a toner image fixed by oil-less fixing is subjected to an ATR FT-IR analysis to obtain the spectrum thereof. The ATR FT-IR method is simple because measurement can be performed by contacting a sample (fixed toner image) with Ge, which has a high refractive index. Therefore, if there is a space above a sample enough for measurement, measurement can be performed without cutting the sample.

In the ATR FT-IR method, the analytic depth of a sample is different depending on the wave number of infrared light. Therefore, when the peak area ratios are determined using peaks having largely different wave numbers, the analytic depths (analytic regions) are also largely different. In this regard, if there is a space between Ge and the sample, the determined peak area ratios have significant errors. However, since the difference in wave number between two peaks used for determining the peak area ratios Ab/Aa and Ab'/Aa' is small, the analytic depths are substantially the same. Therefore, the ratios Ab/Aa and Ab'/Aa' can be precisely determined with good reproducibility.

Figure 5:
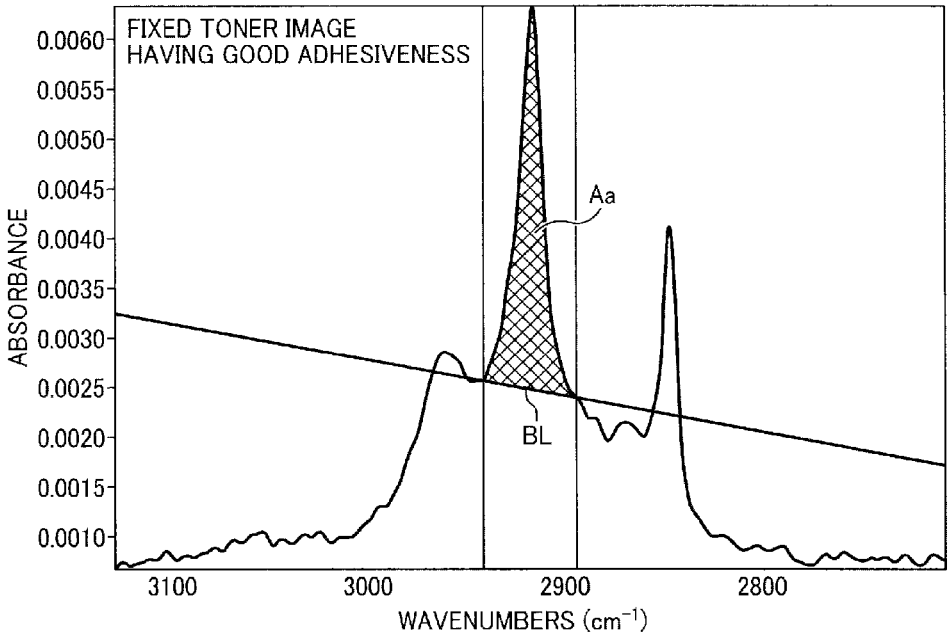
FIG. 5 is a view for describing the method for measuring the peak area Aa of a peak present in a range of from 2896 $cm^{-1}$ to 2943 $cm^{-1}$.
Figure 6:
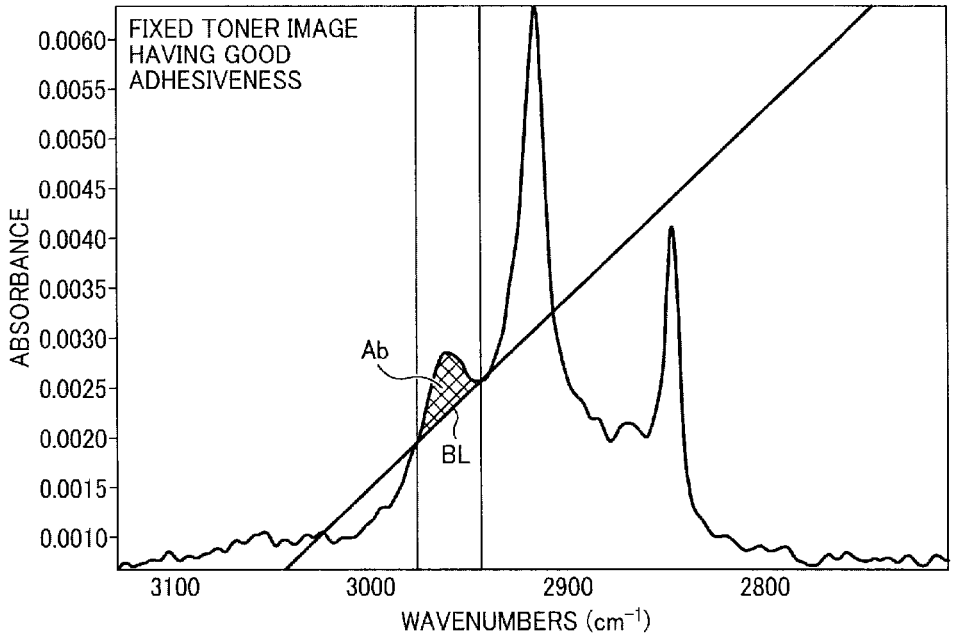
FIG. 6 is a view for describing the method for measuring the peak area Ab of a peak present in a range of from 2946 $cm^{-1}$ to 2979 $cm^{-1}$.

As illustrated in FIG. 5, the peak area Aa of the peak in the range of from 2896 to 2943 $cm^{-1}$ can be determined by measuring the area of a portion (shaded portion) of the peak above a base line BL obtained by connecting the points of the IR spectrum at wave numbers of 2896 $cm^{-1}$ and 2943 $cm^{-1}$. Similarly, as illustrated in FIG. 6, the peak area Ab of the peak in the range of from 2946 to 2979 $cm^{-1}$ can be determined by measuring the area of a portion (shaded portion) of the peak above a base line BL obtained by connecting the points of the IR spectrum at wave numbers of 2946 $cm^{-1}$ and 2979 $cm^{-1}$. Thus, the ratio Ab/Aa can be determined.

Figure 7:
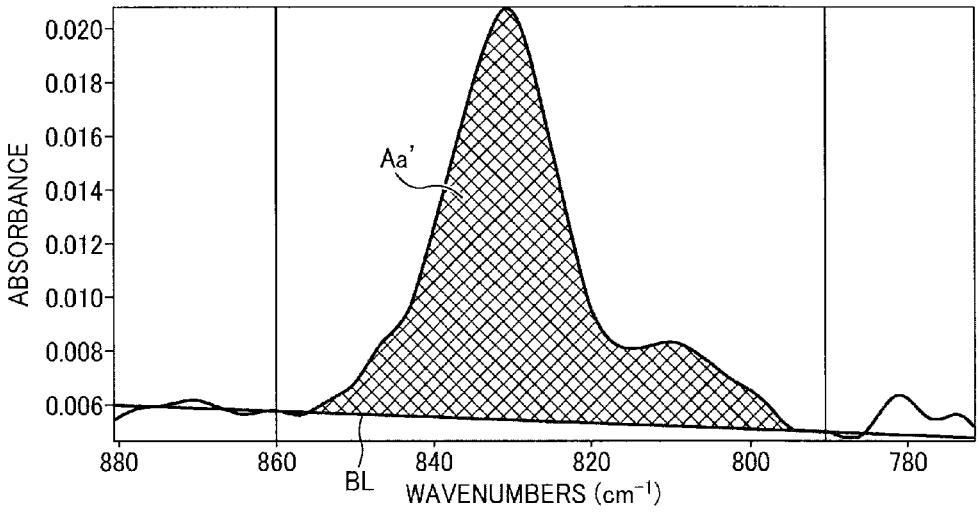
FIG. 7 is a view for describing the method for measuring the peak area Aa' of a peak present in a range of from 791 $cm^{-1}$ to 860 $cm^{-1}$.
Figure 8:
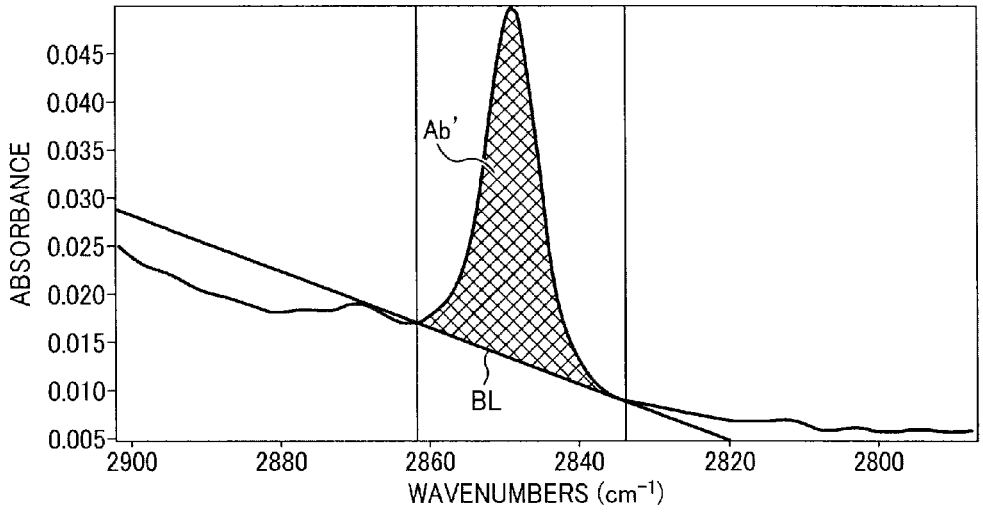
FIG. 8 is a view for describing the method for measuring the peak area Ab' of a peak present in a range of from 2834 $cm^{-1}$ to 2862 $cm^{-1}$.

As illustrated in FIG. 7, the peak area Aa' of the peak in the range of from 791 to 860 $cm^{-1}$ can be determined by measuring the area of a portion (shaded portion) of the peak above a base line BL obtained by connecting the points of the IR spectrum at wave numbers of 791 $cm^{-1}$ and 860 $cm^{-1}$. Similarly, as illustrated in FIG. 8, the peak area Ab' of the peak in the range of from 2834 to 2862 $cm^{-1}$ can be determined by measuring the area of a portion (shaded portion) of the peak above a base line BL obtained by connecting the points of the IR spectrum at wave numbers of 2834 $cm^{-1}$ and 2862 $cm^{-1}$. Thus, the ratio Ab'/Aa' can be determined.

Next, the toner used for the image forming method of the present invention will be described.

The toner used for the image forming method of the present invention is not particularly limited as long as the ratio Ab/Aa of a solid image of the toner fixed by oil-less fixing falls in the range of from 3.0 to 7.0, or the ratio Ab'/Aa' of a solid image of the toner fixed by oil-less fixing falls in the range of from 0.0040 to 0.0140. The toner includes at least a binder resin, a colorant, and a wax, and optionally includes other components such as a charge controlling agent, a magnetic material, and an external additive.

Specific examples of the resin for use as the binder resin include styrene homopolymers and substituted styrene homopolymers such as polystyrene, poly-p-chlorostyrene, and polyvinyl toluene; copolymers of styrene (and substituted styrene) such styrene-p-chlorostyrene copolymers, styrene-propylene copolymers, styrene-vinyl toluene copolymers, styrene-methyl acrylate copolymers, styrene-ethyl acrylate copolymers, styrene-methacrylic acid copolymers, styrene-methyl methacrylate copolymers, styrene-ethyl methacrylate copolymers, styrene-butyl methacrylate copolymers, styrene-methyl α-chloromethacrylate, styrene-acrylonitrile copolymers, styrene-vinyl methyl ether copolymers, styrene-vinyl methyl ketone copolymers, styrene-butadiene copolymers, styrene-isoprene copolymers, and styrene-maleate copolymers; and other resins such as polymethyl methacrylate resins, polybutyl methacrylate resins, polyvinyl chloride resins, polyvinyl acetate resins, polyethylene resins, polyester resins, polyurethane resins, epoxy resins, polyvinyl butyral resins, polyacrylic acid resins, rosin resins, modified rosin resins, terpene resins, phenolic resins, aliphatic or aromatic hydrocarbon resins, and aromatic petroleum resins. These resins can be used alone or in combination. Among these resins, polyester resins are preferably used because of having good affinity for various recording media.

Polyester resins are prepared by reacting an alcohol component such as dihydric alcohols, and tri- or more-hydric alcohols, and an acid component.

Specific examples of such dihydric alcohols include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols prepared by polymerizing a ring ether such as ethylene oxide and propylene oxide with bisphenol A.

Specific examples of such tri- or more-hydric alcohols include sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylol ethane, trimethylol propane, and 1,3,5-trihydroxybenzene.

Specific examples of such acid components include benzenedicarboxylic acids such as phthalic acid, isophthalic acid, and terephthalic acid, and anhydrides thereof; alkyldicarboxylic acids such as succinic acid, adipic acid, sebacic acid, and azelaic acid, and anhydrides thereof; unsaturated dibasic acids such as maleic acid, citraconic acid, itaconic acid, alkenylsuccinic acid, fumaric acid, and mesaconic acid; anhydrides of unsaturated dibasic acids such as maleic anhydride, citraconic anhydride, itaconic anhydride, and alkenylsuccinic anhydride; and polycarboxylic acids having three or more carboxyl groups.

Specific examples of the polycarboxylic acids include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylc acid, 1,3-dicarboxyl-2-methyl-2-methylenecarboxypropane, tetra (methylenecarboxyl)methane, 1,2,7,8-octanetetracarboxylic acid, trimer acids of EMPOL, and anhydrides or partial lower alkyl esters of these acids.

A modified polyester (prepolymer) capable of reacting with a compound having an active hydrogen group can be used for forming a binder resin of the toner. In this regard, the compound having an active hydrogen group serves as a polymer chain growing agent or a crosslinking agent, which performs a polymer chain growth reaction or a crosslinking reaction of the modified polyester in a toner manufacturing process, thereby producing a polymer having a high molecular weight. When such a high molecular weight polymer is used as a binder resin of toner, the toner has good high temperature preservability, and can produce a toner image having low tackiness after being fixed. The modified polyester is not particularly limited as long as the polyester can react with a compound having an active hydrogen group, and specific examples thereof include modified polyesters having a group such as isocyanate, epoxy, carboxyl, and acid chloride groups. Among these modified polyesters, modified polyesters having an isocyanate group are preferable.

The compound having an active hydrogen group is not particularly limited. When a modified polyester having an isocyanate group is used as the modified polyester capable of a compound having an active hydrogen group, an amine is preferably used as the compound having an active hydrogen group because of producing a high molecular weight polymer by performing a reaction such as a polymer chain growth reaction and a crosslinking reaction with the modified polyester.

Any known amines can be used as the polymer chain growing agent or the crosslinking agent. Specific examples thereof include phenylenediamine, diethyltoluenediamine, 4,4'-diaminodiphenyl methane, 4,4'-diamino-3,3'-dimethyldicyclohexyl methane, diaminocyclohexane, isophoronediamine, ethylenediamine, tetramethylenediamine, hexamethylenediamine, diethylenetriamine, triethylentetramine, ethanolamine, hydroxyethyl aniline, aminoethyl mercaptan, aminopropyl mercaptan, aminopropionic acid, and aminocaproic acid. In addition, ketimine compounds and oxazoline compounds, which are obtained by blocking these amines with a ketone such as acetone, methyl ethyl ketone and methyl isobutyl ketone, can also be used.

Any known dyes and pigments can be used as the colorant of the toner. Specific examples of such dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1% to 15% by weight, and more preferably from 3% to 10% by weight of the toner.

Master batches, which are complexes of a colorant with a resin (binder resin), can be used as the colorant of the toner. Specific examples of the resin for use in the master batches include styrene homopolymers and substituted styrene homopolymers, copolymers of styrene and substituted styrene, polymethyl methacrylate resins, polybutyl methacrylate resins, polyvinyl chloride resins, polyvinyl acetate resins, polyethylene resins, polypropylene resins, polyester resins, epoxy resins, epoxy polyol resins, polyurethane resins, polyamide resins, polyvinyl butyral resins, polyacrylic acid resins, rosin, modified rosins, terpene resins, aliphatic hydrocarbon resins, alicyclic hydrocarbon resins, aromatic petroleum resins, chlorinated paraffin, and paraffin. These resins can be used alone or in combination.

The toner includes a wax. Specific examples thereof include animal waxes such as bees waxes, spermaceti and shellac; vegetable waxes such as carnauba waxes, Japan waxes, rice waxes and candelilla waxes; mineral waxes such as montan waxes and ozokerite; and petroleum waxes such as paraffin waxes and microcrystalline waxes. Among these waxes, petroleum waxes are preferable because of having good releasability. Specific examples of the petroleum waxes include paraffin waxes and microcrystalline waxes. These waxes can be used alone or in combination. It is preferable to use two or more waxes having different melting points because the mixture wax has a melting point near the lowest melting point among the different melting points, thereby imparting good releasability to the toner. Since microcrystalline waxes include isoparaffin or cycloparaffin, microcrystalline waxes have relatively small crystal sizes. Therefore, even when a microcrystalline wax is exude from a toner in oil-less fixing, the wax is present on a fixed toner image while unevenly dispersed thereon, thereby making it possible to decrease of the ratios Ab/Aa and Ab'/Aa'.

The wax component included in the toner preferably includes isoparaffin (hydrocarbon) in an amount of not less than 10% by weight so that the resultant toner (i.e., fixed toner image) has good adhesiveness with various overcoat layer composition liquids used for forming the overcoat layer.

The molecular weight of the wax included in the toner is not particularly limited. In general, a component included in the overcoat layer composition and having good adhesiveness with a fixed toner image typically has a high molecular weight. When the wax included in the toner has a high molecular weight near such a component of the overcoat layer composition, the adhesiveness between the overcoat layer and the fixed toner image can be improved. From this point of view, the average molecular weight of the wax included in the toner is preferably not less than 500.

The weight percentage of isoparaffin in a wax and the average molecular weight of a wax can be determined, for example, by using JMS-T100GC "AccuTOF GC" and a Field Desorption (DS) method.

The melting point of the wax included in the toner is preferably from 40° C. to 160° C., and more preferably from 50° C. to 120° C. When the melting point is lower than 40° C., the high temperature preservability of the toner often deteriorates. In contrast, when the melting point is higher than 160° C., a cold offset problem in that a toner image is adhered to a fixing member when the fixing temperature is relatively low is often caused.

The melt viscosity of the wax included in the toner is preferably from 5 mP·s (cps) to 1,000 mP·s, and more preferably from 10 to 100 mP·s. When the viscosity is greater than 1,000 mP·s, effects of improving hot offset resistance and low temperature fixability of the toner cannot be satisfactorily produced.

The content of wax in the toner is preferably from 1% to 40% by weight, and more preferably from 3% to 30% by weight.

The toner used for the image forming method of the present invention can include other components such as charge controlling agents, magnetic materials, and external additives.

The charge controlling agent is not particularly limited, and any known charge controlling agents can be used. Specifically, a positive charge controlling agent is used for a toner to be charged positively, and a negative charge controlling agent is used or a toner to be charged negatively.

Suitable materials for use as the negative charge controlling agent include resins or compounds having a functional group having an electron donating property, azo dyes, and metal complexes of organic acids.

Specific examples of marketed negative charge controlling agents include BONTRONs S-31, S-32, S-34, S-36, S-37, S-39, S-40, S-44, E-81, E-82, E-84, E-86, E-88, A, 1-A, 2-A and 3-A from Orient Chemical Industries Co., Ltd.; KAYACHARGEs N-1 and N-2, and KAYASET BLACKs T-2 and 004, which are from Nippon Kayaku Co., Ltd.; EISENSPIRON BLACKS T-37, T-77, T-95, TRH and TNS-2 from Hodogaya Chemical Co., Ltd.; and FCA-1001-N, FCA-1001-NB and FCA-1001-NZ from Fujikura Kasei Co., Ltd. These negative charge controlling agents can be used alone or in combination.

Suitable materials for use as the positive charge controlling agent include basic compounds such as Nigrosine dyes, cationic compounds such as quaternary ammonium salts, and metal salts of higher fatty acids.

Specific examples of marketed positive charge controlling agents include BONTRONs N-01, N-02, N-03, N-04, N-05, N-07, N-09, N-10, N-11, N-13, P-51, P-52 and AFP-B from Orient Chemical Industries Co., Ltd.; TP-302, TP-415 and TP-4040 from Hodogaya Chemical Co., Ltd.; COPY BLUE PR, and COPY CHARGEs PX-VP-435 and NX-VP-434, which are from Hoechst AG; FCAs 201, 201-B-1, 201-B-2, 201-B-3, 201-PB, 201-PZ and 301 from Fujikura Kasei Co., Ltd.; and PLZs 1001, 2001, 6001 and 7001 from Shikoku Chemicals Corp. These positive charge controlling agents can be used alone or in combination.

The added amount of such a charge controlling agent in the toner is determined depending on variables such as choice of binder resin, and the toner production method used (such as toner component dispersing method used), and is preferably from 0.1 to 10 parts by weight, and more preferably from 0.2 to 5 parts by weight, based on 100 parts by weight of the binder resin used. When the added amount is greater than 10 parts by weight, the charge quantity of the toner excessively increases, thereby excessively increasing electrostatic attraction between the toner and a developing roller, resulting in occurrence of problems in that the fluidity of the developer deteriorates, and image density decreases. In contrast, when the added amount is less than 0.1 parts by weight, the charge rising property of the resultant toner deteriorates and the charge quantity of the resultant toner decreases, thereby deteriorating the image qualities.

The toner optionally includes a magnetic material. Suitable materials for use as the magnetic material include (1) magnetic iron oxides (such as magnetite, maghematite and ferrite), and iron oxides including other metal oxides; (2) metals (such as iron, cobalt and nickel), and metal alloys of these metals with other metals (such as aluminum, copper, lead, magnesium, tin, zinc, antimony, beryllium, bismuth, cadmium, calcium, manganese, selenium, titanium, tungsten, and vanadium; and (3) mixtures of these materials.

Specific examples of the magnetic materials include $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O_{19}$, $NiFe_2O_4$, $NdFe_2O$, $BaFe_{12}O_{19}$, $MgFe_2O_4$, $MnFe_2O_4$, $LaFeO_3$, iron powders, cobalt powders, and nickel powders. These magnetic materials can be used alone or in combination. Among these magnetic materials, $Fe_3O_4$, and $\gamma$-$Fe_2O_3$ are preferable.

The added amount of such a magnetic material in the toner is not particularly limited, and is generally from 10 to 200 parts by weight, and preferably from 20 to 150 parts by weight, based on 100 pats by weight of the binder resin included in the toner.

Such magnetic materials can be used as colorants.

The toner optionally includes one or more external additives. Particulate inorganic materials are used as external additives to impart good fluidity, good high temperature preservability, good developing property, good transferring property, and/or good charging property to the toner.

Specific examples of such particulate inorganic materials include particles of silica, titania, alumina, cerium oxide, strontium titanate, calcium carbonate, magnesium carbonate, and calcium phosphate. In addition, silica subjected to a hydrophobizing treatment using a silicone oil, or hexamethyldisilazane, and titanium oxide subjected to a special surface treatment can also be used as external additives.

Specific examples of marketed products of particulate silica include AEROSILs 130, 200V, 200CF, 300, 300CF, 380, OX50, TT600, MOX80, MOX170, COK84, RX200, RY200, R972, R974, R976, R805, R811, R812, T805, R202, VT222, RX170, RXC, RA200, RA200H, RA-200HS, RM50, RY200 and REA200 from Nippon Aerosil Co., Ltd.; HDKs H20, H2000, H3004, H2000/4, H2050EP, H2015EP, H3050EP and KHD50, and HVK 2150 from Wacker Chemie AG; and CABOSILs L-90, LM-130, LM-150, M-5, PTG, MS-55, H-5, HS-5, EH-5, LM-150D, M-7D, MS-75D, TS-720, TS-610 and TS-530 from Cabot Corp.

These can be used alone or in combination.

The added amount of such a particulate inorganic material in the toner is preferably from 0.1 to 5.0 parts by weight, and more preferably from 0.8 to 3.2 parts by weight, based on 100 parts by weight of the toner.

The toner for use in the image forming method of the present invention preferably has an average circularity SR, which is defined by the below-mentioned equation, of from 0.93 to 1.00, and more preferably from 0.95 to 0.99. The average circularity SR is an index of the asperity of toner particles. When the average circularity SR of the toner is 1.00, the toner particles have spherical form. As the shape of surface of toner particles becomes complex, the average circularity SR of the toner particles decreases.

$$\text{Circularity of a toner particle}(SR)=CL1/CL2,$$

wherein CL1 represents the circumferential length of a circle having the same area as that of the projected image of the toner particle, and CL2 represents the circumferential length of the projected image of the toner particle.

When the average circularity of toner falls in the range of from 0.93 to 1.00, the surface of the toner particles is smooth, and the contact area of toner particles, and the contact area of toner particles and a photoreceptor are small. Therefore, the toner has good transferring property. In addition, since toner particles have no sharp edges, the toner can be agitated in a developing device by a small agitation torque, and therefore the toner can be stably agitated, thereby forming no abnormal images. Further, such a toner hardly cause an omission image problem such that when a dot toner image is transferred onto a recording medium, a dot image having an omission in the center thereof is formed, because toner particles have no sharp edges and therefore transfer pressure is evenly applied to the entire of the toner particles. Furthermore, since toner particles have no sharp edges, the toner has low abrading power, and therefore occurrence of problems such that the surface of photoreceptor is scratched or abraded can be prevented.

In the present application, the average circularity SR of toner is determined by the following method using a flow-type particle image analyzer FPIA-2100 from Sysmex Corp. The procedure is as follows.

(1) at first 100 to 150 ml of water from which solid foreign materials have been removed, 0.1 to 0.5 ml of a surfactant (alkylbenzene sulfonate), and 0.1 to 0.5 g of a sample (i.e., toner) are mixed to prepare a dispersion;

(2) the dispersion is further subjected to a supersonic dispersion treatment for 1 to 3 minutes using a supersonic dispersion machine to prepare a dispersion including particles at a concentration of from 3,000 to 10,000 particles/μl;

(3) the dispersion is passed through a detection area formed on a plate in the instrument; and (4) the particles are optically detected by a CCD camera and then the shapes thereof are analyzed with an image analyzer.

The toner preferably has a volume average particle diameter of from 3 μm to 10 μm, and more preferably from 4 μm to 8 μm. Since particle diameters of toner particles having such a volume average particle diameter are much smaller than the size of a minute electrostatic dot image, images with good dot reproducibility can be produced. When the volume average particle diameter is less than 3 μm, the transfer efficiency of the toner deteriorates, and a cleaning problem in that the toner cannot be easily cleaned by a blade cleaner tends to be caused. In contrast, when the volume average particle diameter is greater than 10 μm, it becomes difficult to avoid a problem in that toner particles constituting a character image or a line image are scattered.

In this regard, the volume average particle diameter is measured, for example, by a Coulter Counter method. Specific examples of measuring instruments for use in the Coulter Counter method include COULTER COUNTER TA-II and COULTER MULTISIZER II (each from Beckman Coulter Inc.).

The method for measuring the volume average particle diameter is as follows. At first, 0.1 ml to 5 ml of a surfactant serving as a dispersant (preferably an aqueous solution of an alkylbenzenesulfonic acid salt) is added to 100 ml to 150 ml of an aqueous electrolyte. In this regard, the electrolyte is a 1% aqueous solution of first class NaCl, and for example, ISOTON-II manufactured by Beckman Coulter Inc. can be used therefor. Next, 2 mg to 20 mg of a sample (toner particles or toner including toner particles and an external additive) to be measured is added thereto. The electrolyte in which the sample is suspended is subjected to an ultrasonic dispersion treatment for about 1 minute to 3 minutes. The volume and number of the sample are measured using the above-mentioned instrument and an aperture of 100 μm to calculate the volume distribution and number distribution thereof. The weight average particle diameter (Dv) and number average particle diameter (Dp) of the sample can be determined from the thus obtained volume and number distributions.

In this case, the particle diameter channels are the following 13 channels:

2.00 μm—less than 2.52 μm; 2.52 μm—less than 3.17 μm; 3.17 μm—less than 4.00 μm; 4.00 μm—less than 5.04 μm; 5.04 μm—less than 6.35 μm; 6.35 μm—less than 8.00 μm; 8.00 μm—less than 10.08 μm; 10.08 μm—less than 12.70 μm; 12.70 μm—less than 16.00 μm; 16.00 μm—less than 20.20 μm;

20.20 μm—less than 25.40 μm; 25.40 μm—less than 32.00 μm; and 32.00 μm—less than 40.30 μm.

Thus, particles having a particle diameter of not less than 2.00 μm and less than 40.30 μm are targeted.

Next, the toner preparation method will be described.

The method for preparing the toner is not particularly limited, and can be selected depending on the application of the toner. For example, there are pulverization methods in which a toner composition is kneaded and the kneaded mixture is pulverized to prepare toner particles; polymerization methods (such as suspension polymerization methods and emulsion polymerization methods) in which a monomer composition including a specific monomer is directly polymerized in an aqueous phase to prepare toner particles; polymer solution emulsifying/suspending methods in which a specific binder resin solution is emulsified or dispersed in an aqueous medium, followed by removing the solvent therefrom to prepare toner particles; methods in which a toner composition is dissolved in a solvent and then the solvent is removed therefrom to prepare a mixed toner composition, followed by pulverizing to prepare toner particles; and spraying methods in which a melted toner composition is sprayed to prepare toner particles.

In pulverization methods, toner components are melted, kneaded, and then cooled. The cooled toner component mixture is pulverized, and then classified to prepare toner particles. In this regard, mechanical impact may be applied to the thus prepared toner particles to adjust the shape of the toner particles. In this case, such mechanical impact is applied to the toner particles using a device such as HYBRIDIZER and MECHANOFUSION.

In the melt kneading operation, toner components are mixed to prepare a toner component mixture, and the mixture is fed to a melt kneader to be subjected to melt kneading. Examples of the kneader include continuous single screw kneaders, continuous twin screw kneaders, and batch kneaders such as roll mills. Specific examples thereof include KTK twin screw extruders manufactured by Kobe Steel, Ltd., TEM twin screw extruders manufactured by Toshiba Machine Co., Ltd., twin screw extruders manufactured by KCK, PCM twin screw extruders manufactured by Ikegai Corp., and KO-KNEADER manufactured by Buss AG.

It is preferable that the melt kneading operation is performed while controlling the kneading temperature so that the molecular chain of the binder resin used is not cut. Specifically, when the kneading temperature is much higher than the softening point of the binder resin, the molecular chain is seriously cut. In contrast, when the kneading temperature is lower than the melting point, toner components cannot be well dispersed.

When the kneaded mixture is pulverized, it is preferable that the kneaded mixture is crushed at first, and then pulverized. In the pulverization process, a method in which crushed particles are collided to a plate using jet air; a method in which crushed particles are collided to each other using jet air; and a method in which crushed particles are pulverized at a narrow gap between a rotor and a stator are preferably used.

The thus pulverized particles are then classified to obtain particles having the predetermined particle diameter. In this classification treatment, small particles can be removed from the pulverized particles using a cyclone, a decanter, or a method using a centrifuge.

After the pulverization operation and the classification operation are performed, the particles are subjected to classification in an air stream utilizing centrifugal force to prepare toner particles having the predetermined particle diameter.

The suspension polymerization method includes, for example, dissolving or dispersing an oil soluble polymerization initiator, one or more polymerizable monomers, a colorant, a wax, and other optional components, in an organic solvent (or the polymerizable monomers may be used as a dispersing medium) to prepare an oil phase liquid; dispersing the oil phase liquid in an aqueous medium including a surfactant or a dispersant to prepare an emulsion or dispersion; and polymerizing the monomers in the emulsion or dispersion to prepare toner particles.

By using a monomer such as acids (e.g., acrylic acid, methacrylic acid, α-cyanoacrylic acid, α-cyanomethacrylic acid, itaconic acid, crotonic acid, fumaric acid, and maleic acid or maleic anhydride), acrylamide, methacrylamide, diacetoneacrylamide, methylol compounds of these amides, vinyl pyridine, vinyl pyrrolidone, vinyl imidazole, ethyleneimine, and acrylate and methacrylate having an amino group such as dimethylaminoethyl methacrylate, as one of the polymerizable monomers, a functional group can be incorporated into the surface of the toner. Alternatively, by using a dispersant having an acid group or a basic group, the dispersant is adsorbed on the surface of toner, and therefore the surface of the toner is functionalized.

The emulsion polymerization method includes emulsifying a water-soluble polymerization initiator, and one or more polymerizable monomers in water using a surfactant to prepare an emulsion; and subjecting the emulsion to polymerization using a known emulsion polymerization method to prepare a dispersion of polymer particles. On the other hand, other toner components such as a colorant and a wax are dispersed in an aqueous medium to prepare a dispersion. The polymer dispersion and the colorant/wax dispersion are mixed, and the mixture is aggregated so as to have substantially the same particle size as that of the toner, followed by heating to melt the aggregated particles to prepare toner particles. By using the above-mentioned functional monomers for the monomers, a functional group can be incorporated into the surface of the toner.

The polymer solution emulsifying/suspending methods include emulsifying or dispersing a solution or a dispersion including toner components including at least a binder resin in an aqueous medium to prepare an emulsion or a dispersion; and then subjecting the emulsion or dispersion to granulation in the aqueous medium. For example, the methods include the following four processes (1) to (4).

Process (1): Preparation of Toner Component Solution or Dispersion

Toner component solution or dispersion can be prepared by dissolving or dispersing toner components such as a colorant and a binder resin in an organic solvent. The organic solvent is removed in the granulation process or after the granulation process as mentioned above.

Process (2): Preparation of Aqueous Medium

The aqueous medium is not particularly limited, and any known aqueous media can be used. Specific examples thereof include water, and mixtures of water and water-compatible solvents such as alcohols, dimethylformamide, tetrahydrofuran, cellosolves, lower ketones, and mixtures thereof. Among these media, water is preferable.

It is preferable that a dispersion stabilizer such as particulate resins is dispersed in the aqueous medium. The added amount of such a dispersion stabilizer is preferably from 0.5 to 10% by weight based on the weight of the aqueous medium.

Any known resins (such as thermoplastic resins and thermosetting resins) which can form an aqueous dispersion can be used for the particulate resins serving as the dispersion stabilizer. Specific examples thereof include vinyl resins, polyurethane resins, epoxy resins, polyester resins, polyamide resins, polyimide resins, silicon resins, phenolic resins, melamine resins, urea resins, aniline resins, ionomer resins, and polycarbonate resins. These resins can be used alone or in combination. Among these resins, vinyl resins, polyurethane resins, epoxy resins, and polyester resins are preferable because an aqueous resin dispersion in which small spherical resin particles are dispersed can be prepared.

In order to stabilize droplets of a toner component solution or dispersion in the aqueous medium while controlling the shape of the droplets and sharpening the particle diameter distribution of the droplets, a dispersant is preferably included in the aqueous medium. The dispersant is not particularly limited, and for example surfactants, inorganic materials which are hardly soluble in water, polymeric protective colloids, and combinations thereof can be used. Among these dispersants, surfactants are preferable.

Process (3): Emulsifying or Dispersing

When the toner component solution or dispersion is emulsified or dispersed in the aqueous medium, agitation is preferably performed using an agitator. Specific examples of the agitator include batch emulsifiers such as homogenizers (from IKA), POLYTRON (from Kinematica AG), and TK AUTO HOMOMIXER (from Tokushu Kika Kogyo Co., Ltd.); continuous emulsifiers such as EBARA MILDER (Ebara Corp.), TK FILMICS and TK PIPE LINE HOMOMIXER (from Tokushu Kika Kogyo Co., Ltd.), colloid mill (from Kobelco Eco-Solutions Co., Ltd.), slasher and trigonal wet pulverizer (from Mitsui Miike Machinery Co., Ltd.), CAVITRON (from Eurotec), and FINE FLOW MILL (from Pacific Machinery & Engineering Co., Ltd.); high pressure emulsifiers such as micro fluidizer (Mizuho Industrial Co., Ltd.), NANOMIZER (from Nanomizer Technology), and APV GAULIN (from Gaulin); emulsifiers using a film such as emulsifiers from Reica Co., Ltd.; vibration emulsifiers such as VIBRO MIXER (from Reica Co., Ltd.); and supersonic emulsifiers such as supersonic homogenizers (from Branson). Among these emulsifiers, APV GAULIN, homogenizer, TK AUTO HOMO MIXER, EBARA MILDER, TK FILMIX, and TK PIPELINE HOMOMIXER are preferable.

When the toner component solution or dispersion includes, as a binder resin, a polyester capable of reacting with a compound having an active hydrogen group, the reaction proceeds in the emulsifying process or dispersing process. The reaction condition is not particularly limited, and is determined depending on the combination of a polyester and a compound having an active hydrogen group used. The reaction time is preferably from 10 minutes to 40 hours, and more preferably from 2 hours to 24 hours.

Process (4): Removal of Solvent

The solvent is removed from the above-prepared emulsion or dispersion. Specific examples of the method include a method in which the entire reaction system (i.e., emulsion or dispersion) is heated to evaporate the organic solvent in the oil droplets, thereby removing the organic solvent from the reaction system; and a method in which the emulsion or dispersion is sprayed into dry atmosphere to remove the organic solvent from the emulsion or dispersion.

Next, the overcoat layer to be formed by the image forming method of the present invention will be described.

It is preferable in the image forming method of the present invention that after an overcoat layer composition liquid is applied on a toner image, which has been fixed to a recording medium, the applied overcoat layer composition liquid is irradiated with light or electron beams to be crosslinked.

An overcoat layer crosslinked by light or electron beams typically has good adhesiveness with binder resins (main components) of toner such as polyester and polystyrene. However, when a toner image is fixed by oil-less fixing, a wax is present on the fixed toner image. Therefore, it is preferable that the adhesiveness between the overcoat layer and the binder resin in the toner is as strong as possible. In this regard, as the affinity of the overcoat layer for the binder resin included in the toner increases, the adhesiveness between the overcoat layer and the binder resin is strengthened. Therefore, it is preferable that the overcoat layer composition liquid properly solves or swells the binder resin included in the toner.

In order to determine whether an overcoat layer composition liquid dissolves or swells a toner, the following dissolution/swelling test method is preferably used.

Figure 13:
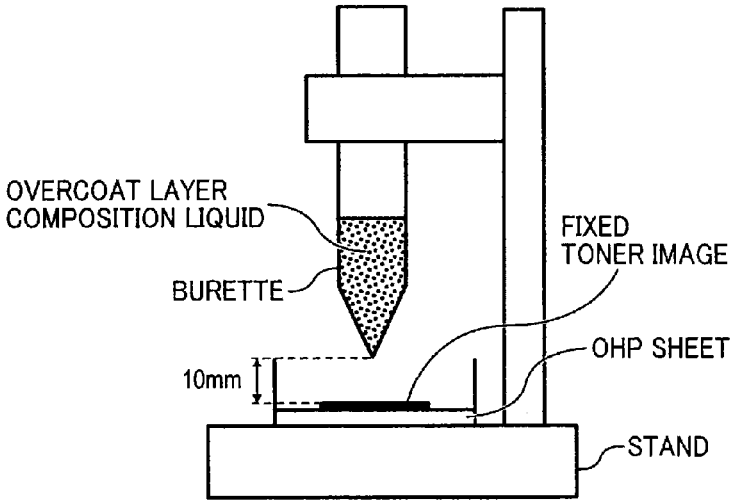
FIG. 13 is a schematic view illustrating a dissolution/swelling tester for use in determining whether an overcoat layer composition liquid dissolves or swells a toner image.

FIG. 13 illustrates a dissolution/swelling tester for use in determining whether an overcoat layer composition liquid dissolves or swells a toner (toner image). Specifically, an overcoat layer composition liquid is dropped from a point 10 mm above a toner image set on a stand of the tester in an amount of from 0.3 to 0.5 mg/cm$^2$. After 10 seconds elapse, the overcoat layer composition liquid is removed from the toner image. The color difference ($\Delta E^*$) between the toner image before the test and the toner image after the test is measured. When the color difference ($\Delta E^*$) is in a range of from 3 to 30, the combination of the overcoat layer composition liquid and the toner is preferable. When the color difference ($\Delta E^*$) is less than 3, the adhesiveness between the overcoat layer and the toner image tends to deteriorate. When the color difference (ΔE*) is greater than 30, the toner image tends to be easily dissolved and damaged by the overcoat layer composition liquid. Namely, when the color difference (ΔE*) is in the above-mentioned range, the adhesiveness between the overcoat layer and the toner image is good. In other words, when the overcoat layer composition liquid properly dissolves the toner, the adhesiveness between the overcoat layer and the toner image can be enhanced without deteriorating the image qualities.

Components such as polymerizable oligomers, polymerizable unsaturated compounds, photopolymerization initiators, sensitizers, polymerization inhibitors, and surfactants are used for the overcoat layer composition liquid.

Any known polymerizable oligomers can be used for the overcoat layer composition liquid. Specific examples thereof include polyester acrylate, epoxy acrylate, and urethane acrylate.

Any known polyester acrylate can be used for the overcoat layer composition liquid. Specific examples thereof include acrylic acid esters of polyester polyols obtained from a polyalcohol and a polybasic acid. Such polyester acrylate has good reactivity.

Any known epoxy acrylate can be used for the overcoat layer composition liquid. Specific examples thereof include epoxy acrylate obtained by a reaction of acrylic acid with an epoxy compound such as bisphenol-type epoxy compounds, novolac type epoxy compounds, or alicyclic epoxy compounds. Such epoxy acrylate has good crosslinking property, and the resultant overcoat layer has a good combination of hardness and flexibility.

Any known urethane acrylate can be used for the overcoat layer composition liquid. Specific examples thereof include urethane acrylate obtained by a reaction of acrylate having diisocyanate and hydroxyl groups with a polyester polyol or a polyether polyol. By using such urethane acrylate, the resultant overcoat layer has a good combination of flexibility and toughness.

These polymerizable oligomers can be used alone or in combination.

The content of such a polymerizable oligomer in the overcoat layer composition liquid is from 5 to 60% by weight, preferably from 10 to 50% by weight, and more preferably from 20 to 45% by weight, based on the weight of the overcoat layer composition liquid. When the content is less than 5% by weight, the overcoat layer composition liquid tends to cause defective crosslinking, the viscosity of the liquid excessively decreases, and the resultant overcoat layer has poor flexibility. In contrast, when the content is greater than 60% by weight, the overcoat layer composition liquid tends to cause problems in that the viscosity thereof excessively increases, and the adhesiveness between the overcoat layer and a toner image deteriorates. When the content is in the above-mentioned range, the overcoat layer composition liquid has a proper viscosity and good crosslinking property, and the resultant overcoat layer has a good combination of flexibility and mechanical strength.

Any known polymerizable unsaturated compounds can be used for the overcoat layer composition liquid. Suitable materials for use as the polymerizable unsaturated compounds include polymerizable monofunctional unsaturated compounds, polymerizable difunctional unsaturated compounds, polymerizable trifunctional unsaturated compounds, and polymerizable tetra- or more-functional unsaturated compounds.

Specific examples of the monofunctional unsaturated compounds include 2-ethylhexyl acrylate, 2-hydroxyethyl acrylate, 2-hydroxypropyl acrylate, benzyl acrylate, phenyl glycol monoacrylate, and cyclohexyl acrylate.

Specific examples of the difunctional unsaturated compounds include 1,4-butanediol diacrylate, 1,6-hexanediol diacrylate, 1,9-nonanediol diacrylate, tripropylene glycol diacrylate, and tetraethylene glycol diacrylate.

Specific examples of the trifunctional unsaturated compounds include trimethylolpropane triacrylate, pentaerythritol triacrylate, and tris(2-hydroxyethyl)isocyanurate triacrylate.

Specific examples of the tetra- or more-functional unsaturated compounds include pentaerythritol tetraacrylate, ditrimethylolpropane tetraacrylate, dipentaerythritol hydroxypentaacrylate, and dipentaerythritol hexaacrylate.

Among these compounds, 1,6-hexanediol diacrylate, ethylcarbitol acrylate, and acryloyl morphorine have good dissolution/swelling ability. Since the above-mentioned compounds have different dissolution/swelling abilities, the added amount of the compounds is preferably adjusted. When the added amount is too small, the adhesiveness between the overcoat layer and a toner image deteriorates. When the added amount is too large, a problem in that a toner image is dissolved and damaged is caused.

The above-mentioned polymerizable unsaturated compounds can be used alone or in combination.

The content of such a polymerizable unsaturated compound in the overcoat layer composition liquid is determined depending on the application of the overcoat layer, and is preferably from 35 to 90% by weight, more preferably from 40 to 85% by weight, and even more preferably from 45 to 75% by weight. When the content is less than 35% by weight, the overcoat layer composition liquid tends to have an excessively high viscosity while causing defective crosslinking. In addition, the resultant overcoat layer (crosslinked layer) tends to have poor flexibility. When the content is in the above-mentioned range, the overcoat layer composition liquid has a good combination of viscosity and crosslinking ability, and the resultant overcoat layer has good properties (e.g., flexibility).

Since polymerizable polyfunctional unsaturated compounds have higher crosslinking speeds than monofunctional polymerizable unsaturated compounds, polymerizable polyfunctional unsaturated compounds can be preferably used for high speed fixing, but the resultant overcoat layer causes large volume contraction. When only a polymerizable compound having such a large volume contraction property is used, the resultant over-coated print tends to largely curl. Therefore, polymerizable unsaturated compounds having small volume contraction property are preferably used because the resultant polymers hardly cause volume contraction. Namely, polymerizable unsaturated compounds having a volume contraction percentage of not greater than 15% are preferable used.

From the viewpoint of the dermal irritation property of the overcoat layer composition liquid, polymerizable unsaturated compounds and polymerizable oligomers having P.I.I. (Primary Irritation Index) of not greater than 1.0 are preferably used. When the P.I.I. is not less than 5.0, the dermal irritation is too strong, and it becomes hard to ensure safety of the compound.

In order not to change the color tone of a toner image, polymerizable unsaturated compounds and polymerizable oligomers used for the overcoat layer composition liquid are preferably colorless or transparent. The color thereof is preferably not greater than 2 in Gardner gray scale. When the color is greater than 2 in Gardner gray scale, the color of a toner image covered with the overcoat layer tends to change, and the color of the background area tends to change.

The photopolymerization initiator used for the overcoat layer composition liquid is not particularly limited. Specific examples thereof include benzophenone, benzoin ethyl ether, benzoin isopropyl ether, and benzil. Marketed photopolymerization initiators can be used. Specific examples thereof include IRGACUREs 1300, 369 and 907 from Ciba Specialty Chemicals; and LUCIRIN TPO from BASF.

When a mixture of a polymerizable oligomer or a polymerizable unsaturated compound and a photopolymerization initiator is irradiated with ultraviolet rays, the initiator generates radicals as illustrated by the following formula (I) or (II).

(I) Hydrogen Extraction Type Photopolymerization Initiator

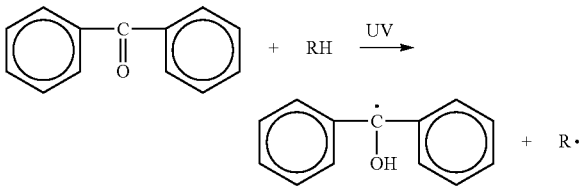

(II) Photo-Cleavage Type Photopolymerization Initiator

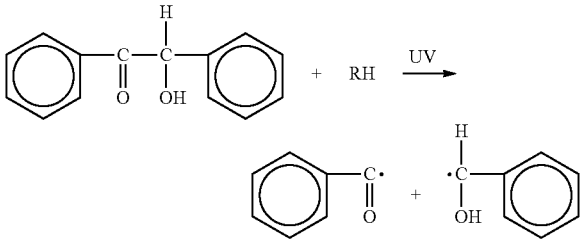

The thus generated radicals cause an addition-reaction with double bonds of the polymerizable oligomer or the polymerizable unsaturated compound. When this addition reaction is caused, radicals are further generated, and the radicals also cause an addition-reaction with double bonds of the polymerizable oligomer or the polymerizable unsaturated compound. Thus, the addition reaction is repeatedly performed, and a polymerization reaction is caused as illustrated by the following formula (III).

(III) Polymerization Reaction

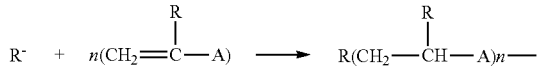

In this regard, it is preferable to use a photopolymerization initiator having the following properties (i)-(iv):

(i) Ultraviolet ray absorption efficiency is high;

(ii) Solubility in the polymerizable oligomer or the polymerizable unsaturated compound used is high;

(iii) Odor, yellowing and toxicity are low; and (iv) Dark reaction is not caused.

The content of a photopolymerization initiator in the overcoat layer composition liquid is preferably from 1% to 10% by weight, and more preferably from 2% to 5% by weight.

When a benzophenone type photopolymerization initiator, which is the hydrogen extraction type initiator mentioned above, is used alone, there is a case where the polymerization reaction speed is slow. In such a case, it is preferable to use an amine type sensitizer to enhance the reactivity. Using such an amine type sensitizer produce effects such that hydrogen can be easily supplied to the initiator in a hydrogen extraction process, and inhibition of the reaction caused by oxygen in the air can be avoided.

Specific examples of such an amine type sensitizer include triethanolamine, triisopropanolamine, 4,4-diethylaminobenzophenone, 2-dimethylaminoethylbenzoic acid, ethyl 4-dimethylaminobenzoate, and isoacyl 4-dimethylaminobenzoate.

The content of such a sensitizer in the overcoat layer composition liquid is preferably from 1% to 15% by weight, and more preferably from 3% to 8% by weight.

A polymerization inhibitor can be included in the overcoat layer composition liquid to enhance the preservability of the overcoat layer composition liquid.

Specific examples of such a polymerization inhibitor include 2,6-di-tert-butyl-p-cresol (BHT), 2,3-dimethyl-6-tert-butyl phenol (IA), anthraquinone, hydroquinone (HQ), and hydroquinone monomethyl ether (MEHQ). The content of such a polymerization inhibitor in the overcoat layer composition liquid is preferably from 0.5% to 3% by weight.

By including a surfactant in the overcoat layer composition liquid, adhesiveness between the overcoat layer composition liquid and a toner image can be enhanced. In addition, since the surface tension of the overcoat layer composition liquid is decreased by a surfactant, the overcoat layer composition liquid can satisfactorily wet a toner image.

Any known surfactants such as anionic surfactants, nonionic surfactants, silicone surfactants, and fluorine-containing surfactants can be used.

Specific examples of such anionic surfactants include sulfosuccinic acid salts, disulfonic acid salts, phosphoric acid esters, sulfuric acid salts, sulfonic acid salts, and mixtures of these materials.

Specific examples of such nonionic surfactants include polyvinyl alcohol, polyacrylic acid, isopropyl alcohol, acetylene type diols, ethoxylated octylphenol, ethoxylated branched secondary alcohols, perfluorobutanesulfonic acid salts, and alkoxylated alcohols.

Specific examples of such silicone surfactants include polyether modified polydimethylsiloxane.

Specific examples of such fluorine-containing surfactants include perfluoroalkylsulfonic acids, perfluoroalkylcalboxylic acids, and fluorotelomer alcohols.

The content of such a surfactant in the overcoat layer composition liquid is preferably from 0.1% to 5% by weight, and more preferably from 0.5% to 3% by weight. When the content is less than 0.1% by weight, the overcoat layer composition liquid cannot satisfactorily wet a toner image. When the content is greater than 5% by weight, crosslinking of the overcoat layer composition liquid is often inhibited. When the content is in the above-mentioned range, the overcoat layer composition liquid can satisfactorily wet a toner image while being satisfactorily crosslinked.

Other components can be included in the overcoat layer composition liquid. Specific examples thereof include leveling agents, matting agents, film-property adjusting agents (such as waxes), and tackifiers, which enhance adhesiveness of the overcoat layer with recording media such as PET and polyolefins without inhibiting polymerization of the polymerizable oligomer or the polymerizable unsaturated compound included in the overcoat layer composition liquid.

The viscosity of the overcoat layer composition liquid is preferably from 10 to 800 mPa·s at 25° C. When the viscosity is less than 10 mPa·s or greater than 800 mPa·s, it often becomes hard to control the thickness of the coated overcoat layer composition liquid. When the viscosity is in the range of from 10 mPa·s to 800 mPa·s, the overcoat layer composition liquid can be evenly applied on a toner image fixed by oil-less fixing. The viscosity can be measured, for example, by a B-type viscometer (from Toyo Seiki Seisaku-Sho, Ltd.).

Solvent-type overcoat layer composition liquids including a solvent can also be used for forming the overcoat layer on a toner image fixed by oil-less fixing. However, from the viewpoints of safety, environmental protection, energy saving and productivity, such (UV) light crosslinking type overcoat layer composition liquids as mentioned above are preferable.

The above-mentioned overcoat layer composition liquid is applied by a coater on a surface of a recording medium bearing thereon a toner image fixed by oil-less fixing.

It is preferable that after a toner image is formed and fixed on a surface of a recording medium, the overcoat layer composition liquid is applied to the surface of the recording medium by a coater like an inline coater for use in printing in which printing and overcoating are performed by a printing machine, or an off-line coater for use in printing in which overcoating is performed right after printing or after a long period of time.

The overcoat layer composition liquid is applied at least on a portion of a toner image formed on a recording medium. Namely, the overcoat layer composition liquid is not necessarily applied to the entire surface of a toner image or the entire surface of a recording medium, and the liquid application area is determined depending on the purpose of the overcoat layer such as protection and/or glossing of images.

The applicator of the overcoat layer composition liquid is not particularly limited, and any known coaters (applicators) can be used. Specific examples thereof include liquid film coaters such as roll coaters, flexo coaters, rod coaters, blade coaters, wire bar coaters, air knife coaters, curtain coaters, slide coaters, doctor knife coaters, screen coaters, gravure coaters (e.g., offset gravure coaters), slot coaters, extrusion coaters, and inkjet coaters. These coaters use coating methods such as normal or reverse roll coating methods, offset gravure coating methods, curtain coating methods, lithography coating methods, screen coating methods, gravure coating methods, and inkjet coating methods.

The thickness of the overcoat layer is preferably from 1 μm to 15 μm on a dry basis. When the thickness is less than 1 μm, problems such that the overcoat layer has a repelled portion (because the overcoat layer composition liquid is repelled by the toner image) or the glossiness of the image portion with the overcoat layer is uneven tend to be caused. When the thickness is greater than 15 μm, the image with the overcoat layer does not have good texture.

After the overcoat layer composition liquid is applied, the applied liquid is preferably crosslinked. When the overcoat layer composition liquid is a photocrosslinkable overcoat layer composition liquid for use in electrophotography, the applied liquid is irradiated with light (such as UV rays) to be crosslinked. When the overcoat layer composition liquid is an oil-based overcoat layer composition liquid for use in electrophotography, the applied liquid is heated to be crosslinked.

The light source for use in irradiating the applied photocrosslinkable overcoat layer composition liquid is not particularly limited, and is determined depending on the property (such as light absorbing property) of the overcoat layer composition liquid. Specific examples thereof include low pressure mercury lamps, medium pressure mercury lamps, high pressure mercury lamps, xenon lamps, carbon arc lamps, metal halide lamps, fluorescent lamps, tungsten lamps, argon ion lasers, helium cadmium lasers, helium neon lasers, krypton ion lasers, laser diodes, YAG lasers, light emitting diodes, CRT light sources, plasma light sources, electron beam emitters, γ ray emitters, ArF excimer lasers, KrF excimer lasers, and F2 lasers.

Figure 9:
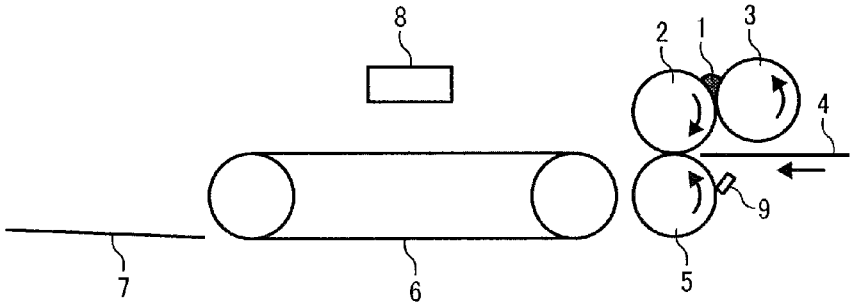
FIG. 9 is a schematic view illustrating a coating device for use in applying an overcoat layer composition liquid.

FIG. 9 illustrates an example of the coater for applying the overcoat layer composition liquid. The coater includes an application roller 2, a metal roller 3, a pressure roller 5, a feeding belt 6, a tray 7, a light source 8, and a scraper 9. As illustrated in FIG. 9, an overcoat layer composition liquid 1 is pooled between the application roller 2 and the metal roller 3. A recording medium 4 bearing a fixed toner image thereon is fed through the nip between the application roller 2 and the pressure roller 5, which are rotated, and the overcoat layer composition liquid 1 on the application roller 2 is transferred to the recording medium 4. Thus, the overcoat layer composition liquid 1 is applied to the recording medium 4.

The recording medium 4 coated with the overcoat layer composition liquid 1 is fed by the feeding belt 6. When the recording medium 4 is fed under the light source 8, the overcoat layer composition liquid 1 on the recording medium 4 is irradiated with UV rays emitted by the light source 8 to be crosslinked. Thereafter, the recording medium 4 bearing an overcoat layer thereon is fed by the feeding belt 6 so as to be stacked on the tray 7.

The overcoat layer composition liquid 1 adhered to the pressure roller 5 is removed therefrom by the scraper 9.

The recording medium for use in the image forming method of the present invention is not particularly limited, and any known materials on which a toner image can be fixed can be used. In addition, the shape of the recording medium is not particularly limited, and sheets, or solids which have a flat surface or a curved surface can be used. In addition, recording media in which a varnish coating (such as a transparent toner layer) is formed on the entire surface of a substrate (such as a paper sheet) to protect the substrate can also be used. The material constituting the recording medium is not particularly limited, and specific examples thereof include fibrous materials such as papers and cloths, plastic films such as OHP sheets which preferably have a liquid penetrating layer, metals, resins, and ceramics.

Next, the image forming method of the present invention, which uses electrophotography, and apparatuses for use in the image forming method will be described.

The image forming method of the present invention includes at least a charging process, an irradiating process, a developing process, a transferring process, a fixing process, and a coating process, and optionally includes other processes such as a discharging process, a cleaning process, a recycling process, and a controlling process. In this regard, a combination of a charging process and an irradiating process is sometimes referred to as an electrostatic latent image forming process.

An electrophotographic image forming apparatus for use in the image forming method includes a photoreceptor, a charger, an irradiator, a developing device, a transferring device, a fixing device, and a coater, and optionally includes a discharger, a cleaner, a recycling device. In this regard, a combination of a charger and an irradiator is sometimes referred to as an electrostatic latent image forming device. In addition, two or more of the above-mentioned devices may be integrated into a single unit (i.e., process cartridge) so as to be detachably attached to an electrophotographic image forming apparatus.

The charging, irradiating, developing, transferring, fixing, coating, discharging, cleaning and recycling processes are respectively performed by the charger, the irradiator, the developing device, the transferring device, the fixing device, the coater, the discharger, the cleaner and the recycling device.

Next, the processes and devices will be described in detail.

In the electrostatic latent image forming process (i.e., a combination of a charging process and an irradiating process), an electrostatic latent image is formed on an electrophotographic photoreceptor. The electrostatic latent image forming device forms an electrostatic latent image on an electrophotographic photoreceptor.

Formation of an electrostatic latent image can be performed, for example, by charging a photoreceptor and then irradiating the charged photoreceptor with light including image information.

The electrostatic latent image forming device includes at least a charger to charge a photoreceptor, and an irradiator to irradiate the charged photoreceptor with light including image information.

The charging process is performed, for example, by applying a voltage to the surface of a photoreceptor using a charger. The charge is not particularly limited, and is properly selected from known charging devices. Specific examples of the charger include contact chargers having conductive or semi-conductive charging members such as rollers, brushes, films and rubber blades, and non-contact chargers utilizing corona discharging such as corotron and scorotron.

The charging member is not limited to charging rollers, and other members such as magnetic brush shapes and fur brushes can also be used depending on the specification or configuration of the image forming apparatus. For example, magnetic brushes having a brush made of a ferrite (such as Zn—Cu ferrite), a non-magnetic electroconductive sleeve serving as a support for supporting the brush, and a magnet roller located inside the sleeve can be used. In addition, fur brushes having a fur subjected to an electroconductive treatment using carbon, copper sulfide, a metal or a metal oxide, and a core member which is a metal core or a core subjected to an electroconductive treatment and to which the fur is attached can also be used.

Among the chargers, contact chargers are preferably used because the amount of ozone generated thereby is relatively small.

In the charging process, it is preferable to apply a DC voltage on which an AC voltage is superimposed to the surface of a photoreceptor using a contact or non-contact charger. In addition, a short-range charger to apply a DC voltage or a DC voltage on which an AC voltage is superimposed to the surface of a photoreceptor with a small gap therebetween, which is formed using a gap tape or the like, can also be preferably used.

The irradiation process can be performed by irradiating the charged photoreceptor with an irradiator.

The irradiator is not particularly limited, and any known irradiators which can irradiate a photoreceptor with light including image information can be used. Specific examples of the irradiator include optical devices used for copiers, rod lens arrays, optical devices using laser, and optical devices using a LED shutter. In this regard, it is preferable to form an electrostatic latent image on a photoreceptor using a digital image forming method.

It is possible to irradiate a photoreceptor from the backside of the photoreceptor.

In the developing process, the electrostatic latent image formed on the photoreceptor is developed with the toner mentioned above or a developer including the toner to form a toner image on the photoreceptor. The developing device develops the electrostatic latent image formed on the photoreceptor with a toner or a developer including a toner to form a toner image on the photoreceptor.

The developing device is not particularly limited as long as the device can develop and electrostatic latent image using the toner or a developer using the toner. For example, a developing device which contains therein the toner or a developer using the toner, and supplies the toner to an electrostatic latent image in a contact or non-contact manner can be preferably used.

The developing device is a dry developing device using a dry toner or developer or a wet developing device using a liquid developer in which a toner is dispersed. In addition, the developing device is a monochromatic developing device using one color toner or developer, or a multi-color developing device using two or more color toners or developers. Among dry developing devices, developing devices including an agitator to agitate the toner or a developer including the toner to charge the toner, and a rotatable magnet roller to bear the toner or the developer thereon to supply the toner to an electrostatic latent image are preferable. For example, in a developing device using a two-component developer including a toner and a carrier, the developer is mixed and agitated so that the toner therein is charged by friction, and the developer is born on the surface of a rotating magnet roller while forming a magnetic brush on the surface of the magnet roller. Since the magnet roller is provided in the vicinity of the photoreceptor, the toner included in the magnetic brush is attracted by the electrostatic force of the electrostatic latent image on the photoreceptor, and part of the toner is transferred to the photoreceptor. As a result, the electrostatic latent image is developed by the toner, and a toner image is formed on the surface of the photoreceptor.

The developer is a one-component developer or a two-component developer.

In the transferring process, the toner image formed on the photoreceptor is transferred onto a recording medium. The transferring device transfers the toner image formed on the photoreceptor onto a recording medium.

In the transferring process, intermediate transfer methods in which a toner image formed on a photoreceptor is primarily transferred onto an intermediate transfer medium, and the primarily transferred toner image is secondarily transferred onto a recording medium are preferable. Among such intermediate transfer methods, multi-color transfer methods in which two or more color toner images, and preferably full color toner images, which are formed on one or more photoreceptors, are transferred onto an intermediate transfer medium by a primary transferring device to form a combined color toner image thereon, and the combined color toner image is then transferred onto a recording medium using a secondary transfer device are preferable.

The transferring process can be performed, for example, by charging the toner image on the photoreceptor using the transferring device. The transferring device preferably includes a primary transfer device to transfer two or more toner images formed on one or more photoreceptors to an intermediate transfer medium to form a combined toner image, and a secondary transfer device to transfer the combined toner image onto a recording medium.

The intermediate transfer medium is not particularly limited, and any known intermediate transfer media such as intermediate transfer belts can be used.

The transferring device (primary transferring device, and secondary transferring device) preferably includes at least a transferring member to charge the toner image to transfer the toner image onto a recording medium or an intermediate transfer medium. The transferring device is a single transferring device or a combination of two or more transferring devices.

Specific examples of the transferring member include corona transferring members using corona discharging, transferring belts, transferring rollers, pressure transferring rollers, and adhesive transferring members using an adhesive force.

The recording medium for use in the image forming method is the recording medium mentioned above in describing the overcoat layer composition liquid.

In the fixing process, the toner image (unfixed toner image) formed on a recording medium is fixed thereto by a fixing device. The fixing device fixes the toner image (unfixed toner image) formed on a recording medium to the recording medium using a fixing member. When two or more toner images are formed on a recording medium one by one, the fixing process is performed after every transferring process or after all the transferring processes.

The fixing device is not particularly limited, and any known fixing devices can be used. Among these fixing devices, heat and pressure fixing devices are preferable. Specific examples of such heat and pressure fixing devices include fixing devices using a heat roller (which serves as a fixing member) and a pressure roller, and fixing devices using a heat roller, a pressure roller and an endless belt (which serves as a fixing member). In this regard, the heating temperature is preferably 80 to 200° C. In addition, known light fixing devices can be used alone or in combination with the above-mentioned fixing devices.

In the discharging process, a discharge bias is applied to the photoreceptor after the transferring process to reduce charges remaining on the photoreceptor even after the transferring process. The discharger applies a discharge bias to the photoreceptor. The discharger is not particularly limited, and any known dischargers capable of applying a discharge bias can be used. For example, discharge lamps can be preferably used.

In the cleaning process, toner remaining on the photoreceptor even after the transferring process is removed therefrom. The cleaner removes toner particles remaining on the photoreceptor even after the transferring process. The cleaner is not particularly limited, and any known cleaners capable of removing toner remaining on a photoreceptor can be used. Specific examples thereof include magnetic brush cleaners, electrostatic brush cleaners, magnetic roller cleaners, blade cleaners, brush cleaners, and web cleaners.

In the recycling process, the toner collected in the cleaning process is returned to the developing device to recycle the toner. The recycling device returns the toner collected in the cleaning process to the developing device. The recycling device is not particularly limited, and any known devices capable of feeding toner or the like can be used.

In the controlling process, the above-mentioned processes are controlled by a controller. The controller is not particularly limited, and any known controllers can be used as long as the controllers can control operations of all the devices mentioned above. Specific examples thereof include sequencers, and computers.

Next, image forming apparatuses performing the image forming method of the present invention will be described.

Figure 10:
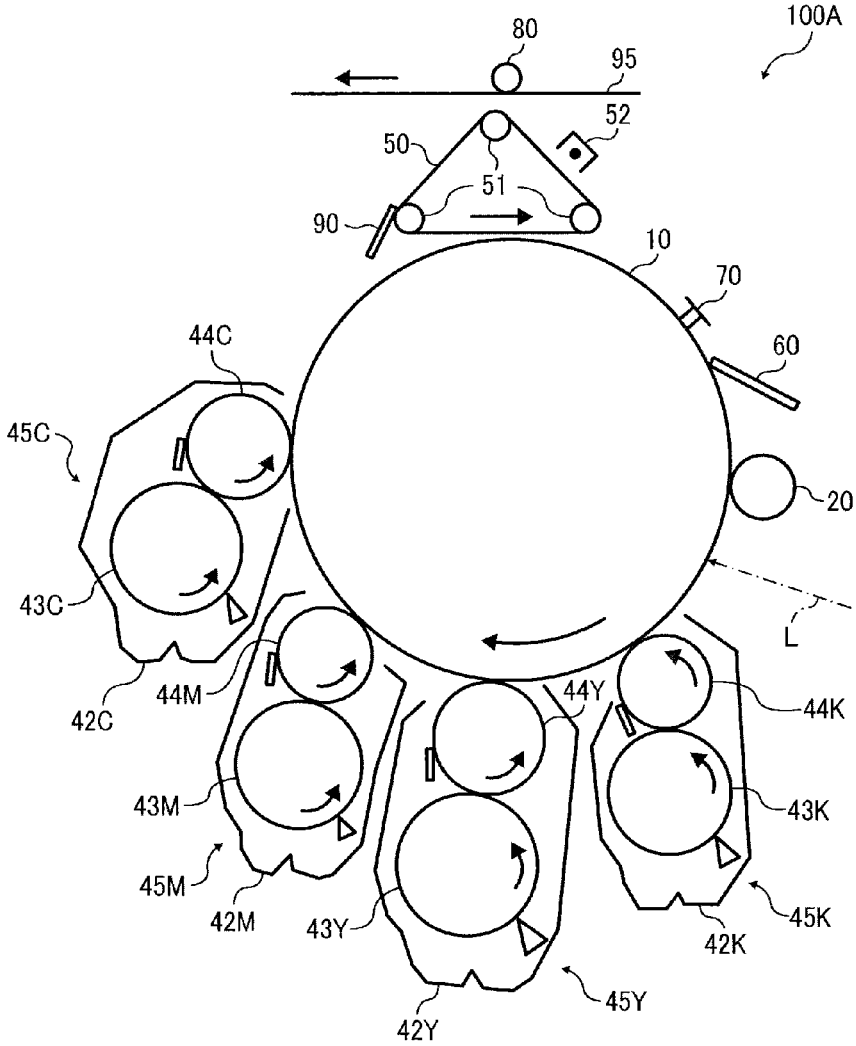
FIG. 10 is a schematic view illustrating an image forming apparatus using the image forming method of the present invention.

FIG. 10 illustrates an image forming apparatus performing the image forming method of the present invention. Referring to FIG. 10, an image forming apparatus 100A includes a photoreceptor drum 10, a charging roller 20 serving as the charger mentioned above, an irradiator (not shown) serving as the irradiator mentioned above and irradiating the photoreceptor drum 10 with light L, a developing device 45 which serves as the developing device mentioned above and which includes a black developing device 45K, a yellow developing device 45Y, a magenta developing device 45M, and a cyan developing device 45C, an intermediate transfer medium 50, a cleaner 60 which serves as the cleaner mentioned above and which includes a cleaning blade, and a discharging lamp 70 serving as the discharger mentioned above.

The intermediate transfer medium 50 is an endless belt, which is rotated in a direction indicated by an arrow while tightly stretched by three rollers 51 provided inside the endless belt. One or more of the rollers 51 serve as a transfer bias roller to apply a predetermined transfer bias (primary transfer bias) to the intermediate transfer medium 50.

A cleaner 90 having a cleaning blade is provided in the vicinity of the intermediate transfer medium 50 to clean the surface of the intermediate transfer medium. In addition, a secondary transfer roller 80 is provided so as to be opposed to the intermediate transfer medium 50 to apply a secondary transfer bias to a recording medium 95 so that the toner image on the intermediate transfer medium is satisfactorily transferred onto the recording medium.

In addition, a corona charger 52 to apply a charge to the toner image on the intermediate transfer medium 50 is provided at a location between the contact portion of the photoreceptor drum 10 with the intermediate transfer medium 50 and the contact portion of the intermediate transfer medium 50 with the recording medium 95.

Each of the black (K), yellow (Y), magenta (M) and cyan (C) developing devices 45K, 45Y, 45M and 45C has a developer container 42 (42K, 42Y, 42M or 42C), a developer supplying roller 43 (43K, 43Y, 43M or 43C), and a developing roller 44 (44K, 44Y, 44M or 44C).

In the image forming apparatus 100A, after the charging roller 20 evenly charges the photoreceptor drum 10, the irradiator (not shown) irradiates the charged photoreceptor with light L including image information to form electrostatic latent images on the photoreceptor drum. Next, the developing devices 45K, 45Y, 45M and 45C supply the K, Y, M and C developers to develop the electrostatic latent images, resulting in formation of color toner images on the photoreceptor drum 10. The color toner images are primarily transferred onto the intermediate transfer medium 50 one by one to form a combined color toner image on the intermediate transfer medium. After the combined color toner image on the intermediate transfer medium 50 is charged by the corona charger 52, the combined color toner image is secondarily transferred onto the recording medium 95 by the secondary transfer roller 80. Toner remaining on the photoreceptor drum 10 even after the primary transfer process is removed therefrom by the cleaner 60, and the photoreceptor drum 10 is then discharged by the discharging lamp 70 so that the photoreceptor is ready for the next image forming operation. The recording medium 95 bearing the combined color toner image thereon is fed in a direction indicated by an arrow so as to be fed into a fixing device (not shown in FIG. 10).

In the image forming apparatus 100A, a coater (such as the coater illustrated in FIG. 9) to apply the overcoat layer composition liquid can be arranged at any position after a fixing device.

Figure 11:
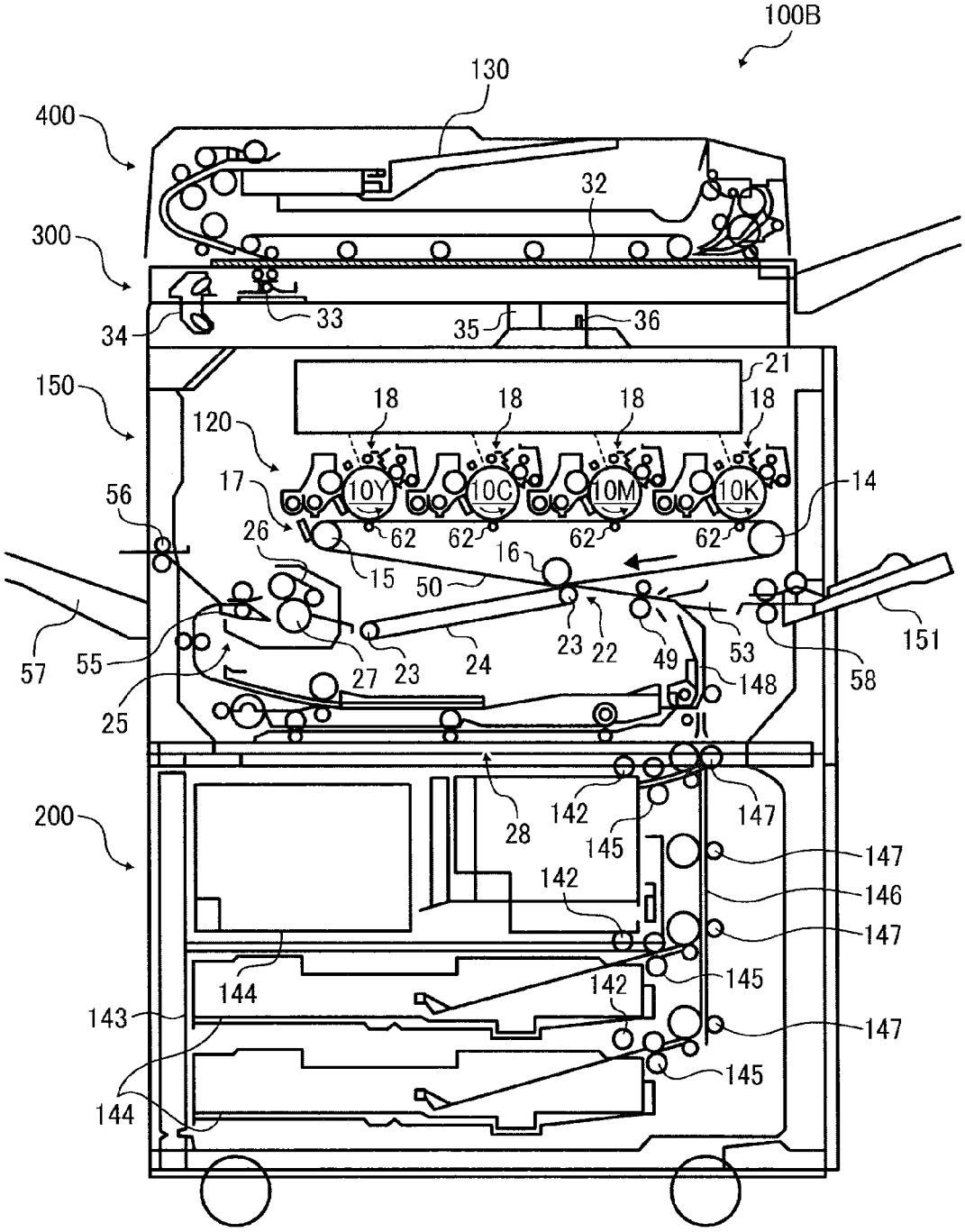
FIG. 11 is a schematic view illustrating another image forming apparatus using the image forming method of the present invention.

FIG. 11 illustrates another image forming apparatus 100B using the image forming method of the present invention. Referring to FIG. 11, the image forming apparatus 100B is a tandem color image forming apparatus including an image forming section 150, a recording sheet feeding device 200, a scanner 300, and an automatic document feeder (ADF) 400.

The image forming section 150 includes the endless intermediate transfer medium 50 in the center thereof. The intermediate transfer medium 50 is tightly stretched by support rollers 14, 15 and 16 while rotated thereby in a direction indicated by an arrow.

Figure 12:
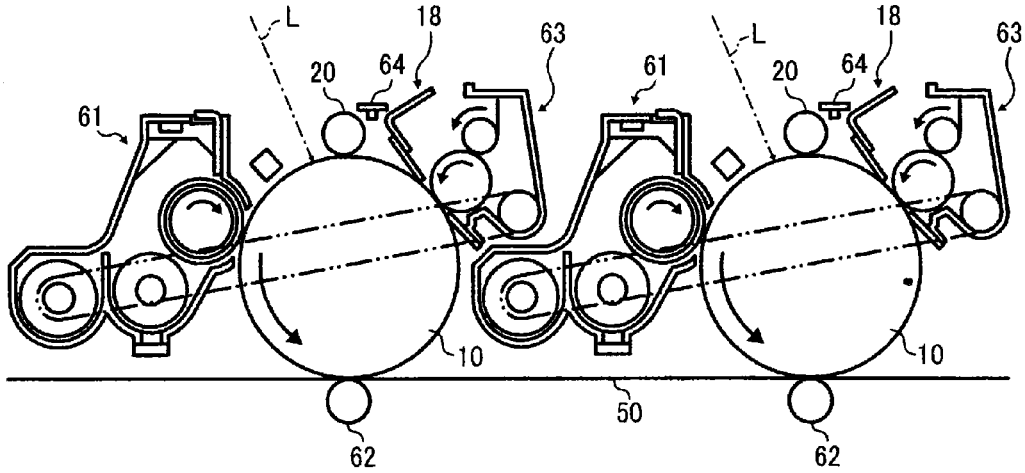
FIG. 12 illustrates a tandem developing device of the image forming apparatus illustrated in FIG. 11.

In the vicinity of the support roller 15, a cleaner 17 is provided to remove toner remaining on the intermediate transfer medium 50 even after the secondary transfer process. Above the upper portion of the intermediate transfer medium 50, which is tightly stretched by the support rollers 14 and 15, a tandem image forming device 120, in which yellow, cyan, magenta and black image forming devices 18 are arranged side by side, is provided so as to be opposed to the upper portion of the intermediate transfer medium 50. As illustrated in FIG. 12, each of the image forming device 18 includes the photoreceptor drum 10, the charging roller 20 to evenly charge the photoreceptor drum 10, a developing device 61 which develops an electrostatic latent image formed on the photoreceptor drum 10 using a developer including K, Y, M, or C toner to form a K, Y, M or C toner image on the photoreceptor drum, a transfer roller 62 to transfer the toner image on the photoreceptor drum 10 to the intermediate transfer medium 50, a cleaner 63 to clean the surface of the photoreceptor drum 10, and a discharging lamp 64 to discharge the photoreceptor drum 10.

Referring back to FIG. 11, in the vicinity of the tandem image forming device 120, an irradiator 21 is provided to irradiate the photoreceptor drums 10 (10K, 10Y, 10M and 10C) with light including information of K, Y, M and C color images to form electrostatic latent images corresponding to K, Y, M and C images on the corresponding photoreceptor drums 10 (10K, 10Y, 10M and 10C).

A secondary transfer device 22 is provided in the vicinity of the lower portion of the intermediate transfer medium 50 so as to be contacted with the support roller 16 with the intermediate transfer medium therebetween. The secondary transfer device 22 includes an endless secondary transfer belt 24 tightly stretched by a pair of rollers 23 while rotated. The endless secondary transfer belt 24 feeds the recording medium fed from the recording sheet feeding device 200 while bringing the recording medium in contact with the intermediate transfer medium 50.

In the vicinity of the secondary transfer device 22, a fixing device 25 is provided which includes an endless fixing belt 26, and a pressure roller 27 contacted with the fixing belt 26.

In addition, a reversing device 28 is provided in the vicinity of the secondary transfer device 22 and the fixing device 25 to feed the recording medium bearing a toner image thereon toward the secondary transfer device 22 while reversing the recoding medium to prepare a duplex copy.

Next, a full color image forming operation of the image forming apparatus 100B will be described.

An original to be copied is set on an original table 130 of the automatic document feeder 400. Alternatively, the original may be directly set on a glass plate 32 of the scanner 300 after the automatic document feeder 400 is opened, followed by closing the automatic document feeder 400. When a start button (not shown) is pushed, the color image of the original set on the glass plate 32 is scanned with a first traveler 33 and a second traveler 34, which move in the right direction in FIG. 11. In the case where the original is set on the table 130 of the automatic document feeder 400, at first the original is fed to the glass plate 32, and then the color image thereon is scanned with the first and second travelers 33 and 34. The first traveler 33 irradiates the color image on the original with light and the second traveler 34 reflects light reflected from the color image to send the color light image to a sensor 36 via a focusing lens 35. Thus, color image information (i.e., black, yellow, magenta and cyan color image data) of the color image on the original is provided.

Next, the irradiator 21 irradiates the photoreceptor drums 10 with light according to the color image information to prepare electrostatic latent images on the photoreceptor drums 10. The developing devices 61 (FIG. 12) develop the electrostatic latent images using K, Y, M and C developers to prepare K, Y, M and C toner images on the photoreceptor drums 10. The K, Y, M and C toner images are transferred onto the intermediate transfer medium 50 one by one by the transfer rollers 62, thereby forming a combined color toner image on the intermediate transfer medium 50.

In the recording sheet feeding device 200, one of sheet feeding rollers 142 is selectively rotated to feed the uppermost sheet of recording sheets stacked in one of sheet cassettes 144 in a paper bank 143 while the recording sheet is separated one by one by a separation roller 145 when plural paper sheets are continuously fed. The recording sheet is then fed by feed rollers 147 to a passage 148 in the image forming section 150 through a passage 146 in the recording sheet feeding device 200, and is stopped once by a pair of registration rollers 49. A recording sheet can also be fed while separated by a separation roller 58 from a manual sheet tray 151, and the thus fed recording sheet is fed to a passage 53. The thus fed recording sheet is also stopped once by the pair of registration rollers 49. The registration rollers 49 are generally grounded, but a bias can be applied thereto to remove paper dust therefrom.

The combined color toner image thus formed on the intermediate transfer medium 50 is secondarily transferred to the recording sheet, which is timely fed by the registration rollers 49, at the nip between the intermediate transfer medium and the second transfer device 22.

The recording sheet having the combined color toner image thereon is then fed by the second transfer device 22 to the fixing device 25, and the toner image is fixed on the recording sheet upon application of heat and pressure thereto by the fixing belt 26 and the pressure roller 27. The recording sheet bearing a fixed toner image thereon is discharged from the image forming section 150 by a discharge roller 56 while the path is properly selected by a sheet path switching pick 55. Thus, a copy is stacked on a copy tray 57. When a duplex copy is produced, the sheet path switching pick 55 is switched to feed the recording sheet having a toner image on one side thereof to the reversing device 28 to reverse the recording sheet. The reversed recording sheet is then fed again to the secondary transfer nip so that a second image formed on the intermediate transfer belt 50 is transferred to the other side of the recording sheet by the second transfer device 22. The second image formed on the other side of the recording sheet is also fixed by the fixing device 25 and the duplex copy is discharged to the copy tray 57 by the discharge roller 56.

Particles of the toner remaining on the surface of the intermediate transfer medium 50 even after the combined color toner image is transferred are removed therefrom by the cleaner 17.

In the image forming apparatus 100B, the overcoat layer coating device can be provided at any position after the fixing device 25.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

In the following examples, the weight percentage of isoparaffins in a wax, and the average molecular weight of waxes were measured using JMS-T100GC "AccuTOF GC" and a Field Desorption (FD) method.

Example 1

Preparation of Color Toners 1 and Developers 1

The following components were mixed.

| | |
|---|---|
| Polyester resin (weight average molecular weight (MW) of 68,500, and glass transition temperature (Tg) of 65.9° C.) | 89.5 parts |
| Microcrystalline wax (including isoparaffins in an amount of 15% by weight, and having an average molecular weight of 650) | 5 parts |
| Carbon black (#44 from Mitsubishi Chemical Corp.) | 5 parts |
| Charge controlling agent (SPIRON BLACK TR-H from Hodogaya Chemical Co., Ltd.) | 1 part |

The mixture was kneaded at 120° C. using a twin-screw extruder (type BCTA from Buhler), and the kneaded mixture was pulverized using an jet air pulverizer (JET MILL from Nisshin Engineering Inc.). The pulverized mixture was classified to obtain black color particles having a volume average particle diameter of 8.0 μm. A silica (R-972 from Nippon Aerosil Co.) was added to the black color particles in an amount of 2.2% by weight based on the black color particles, and the mixture was agitated by a HENSCHEL MIXER mixer (type FM from Nippon Coke & Engineering Co., Ltd.) to prepare a black toner 1.

The procedure for preparation of the black toner 1 was repeated except that the carbon black serving as a colorant was replaced with each of Pigment Yellow 17, Pigment Red 57 and Pigment Blue 15 to prepare a yellow toner 1, a magenta toner 1 and a cyan toner 1.

Each of these black, yellow, magenta and cyan toners 1 had a circularity of 0.90 and a volume average particle diameter of 8.0 μm.

Each of these toners 1 was mixed with a carrier, which is particulate magnetite having an average particle diameter of 50 μm having thereon a silicone resin layer with a thickness of 0.5 μm to prepare K, Y, M and C developers 1 each having a toner concentration of 5.0% by weight.

Preparation of Overcoat Layer Composition Liquid 1

The following components were fed into a beaker.

| | |
|---|---|
| Pentaerythritol tetraacrylate | 11 parts |
| Trimethylolpropane triacrylate | 30 parts |
| Hydroquinone (polymerization inhibitor) | 0.3 parts |

After the mixture was hated to 120° C. while agitated, 50 parts of diallyl phthalate prepolymer (DAISO DAP 100 from Daiso Co., Ltd.) was added to the mixture to be dissolved therein. In addition, a dispersion prepared by dispersing 2 parts of aluminum isopropylate in 2 parts of toluene was gradually added thereto, and the mixture was agitated for 20 minutes at 110° C. to remove toluene from the mixture. Thus, a photo-crosslinkable varnish was prepared.

In addition, the following components were mixed.

| | |
|---|---|
| Photo-crosslinkable varnish prepared above | 75 parts |
| 1,6-Hexanediol acrylate | 60 parts |
| Benzophenone (Photopolymerization initiator) | 10 parts |
| p-Dimethylaminoacetophenone | 5 parts |
| Phenylglycol monoacrylate (viscosity modifier) | 10 parts |

The mixture was kneaded by a 3-roll mill to prepare a photo-crosslinkable overcoat layer component liquid 1.

The following evaluations were performed.

1. Dissolution/Swelling Test

A fixed red toner image having a weight of 0.8 mg/cm$^2$ was formed on an OHP sheet by overlaying an image of the magenta toner 1 and an image of the yellow toner 1. After the red toner image was covered with another sheet of the OHP sheet (hereinafter referred to as a cover OHP sheet), the L*, a* and b* of the red image were measured with a spectrodensitometer X-RITE 938 from X-Rite Inc.

The OHP sheet bearing the red toner image thereon, which is not covered with the cover OHP sheet, was set on the stand of the dissolution/swelling tester illustrated in FIG. 13. The overcoat layer composition liquid 1 was dropped from a point 10 mm above the red image in an amount of from 0.3 to 0.5 mg/cm$^2$ using a burette. After 10 seconds elapsed, the overcoat layer composition liquid 1 was removed from the red toner image. After the red toner image was covered with the cover OHP sheet, the L*, a* and b* of the red image were measured again with the spectrodensitometer X-RITE 938 to determine the color difference (ΔE*) between the red toner image before the test and the red toner image after the test. In this regard, the reason why the red toner image is covered with the cover OHP sheet when measuring the L*, a* and b* is to protect the spectrodensitometer from being contaminated by the toner image and the overcoat layer composition liquid.

2. Viscosity of Overcoat Layer Composition Liquid

The viscosity of the overcoat layer composition liquid 1 was measured at 25° C. using a B-type viscometer from Toyo Seiki Seisaku-Sho Ltd.

3. Evaluation of Print

The image of a test chart No. 4 of ISO/IEC 15775:1999 was reproduced on a recording medium, POD GLOSS COAT having a weight of 128 g/m$^2$ and manufactured by Oji Paper Co., Ltd. using an image forming apparatus IMAGIO MP C7500 from Ricoh Co., Ltd. In this regard, the weight of a solid toner image was controlled so as to be 0.4 mg/cm$^2$.

(1) Measurement of Ab/Aa

The red, green and blue solid images of the above-prepared copy were subjected to an ATR FT-IR analysis using an infrared spectrometer, FT-IR-6100 from JASCO Corp. under the conditions mentioned below.

The Aa and Ab were determined from the IR spectra under the below-mentioned conditions to determine ratios Ab/Aa of the red, green and blue solid images. Among these Ab/Aa ratios, the maximum Ab/Aa ratio is illustrated in Table 1 below.

ATR FT-IR conditions:

Crystal used: Ge

Incident angle: 45°

Pressure: 2.3 kg

Number of reflectance: one

The area Aa is defined as the area of a portion of the peak above a base line base of the peak in the range of from 2896 cm$^{-1}$ to 2943 cm$^{-1}$, which is obtained by connecting a point of the peak at 2896 cm$^{-1}$ with a point of the peak at 2943 cm$^{-1}$.

The area Ab is defined as the area of a portion of the peak above a base line base of the peak in the range of from 2946 $cm^{-1}$ to 2979 $cm^{-1}$, which is obtained by connecting a point of the peak at 2946 $cm^{-1}$ with a point of the peak at 2979 $cm^{-1}$.

The area Aa' is defined as the area of a portion of the peak above a base line base of the peak in the range of from 791 $cm^{-1}$ to 860 $cm^{-1}$, which is obtained by connecting a point of the peak at 791 $cm^{-1}$ with a point of the peak at 860 $cm^{-1}$.

The area Ab' is defined as the area of a portion of the peak above a base line base of the peak in the range of from 2834 $cm^{-1}$ to 2862 $cm^{-1}$, which is obtained by connecting a point of the peak at 2834 $cm^{-1}$ with a point of the peak at 2862 $cm^{-1}$.

(2) Wettability of Overcoat Layer Composition Liquid (i.e., Liquid Repelling Property of Toner Image)

The overcoat layer composition liquid 1 was applied on the image of the copy prepared above using a UV varnish coater (SG610V from Shinano Kenshi Co., Ltd.) under the following conditions:

Coating speed: 10 m/min

Irradiance: 120 W/cm

Weight of coated overcoat layer composition liquid: 5 g/$cm^2$ (4.5 μm)

In this coating operation, a photo-crosslinkable overcoat layer composition liquid was crosslinked. An oil-based overcoat layer composition liquid was crosslinked by being dried in a chamber without irradiated with UV rays. The crosslinked overcoat layer was visually observed to determine whether the toner image repels the overcoat layer (i.e., to evaluate the wettability of the overcoat layer composition liquid). The wettability of the overcoat layer composition liquid was graded as follows.

○: The overcoat layer has no repelled portion. (Good)

Δ: The overcoat layer has a slightly-repelled portion, but the overcoat layer is on an acceptable level.

X: The overcoat layer has seriously-repelled portion. (Bad)

(3) Adhesiveness of Overcoat Layer

The procedure for preparation of the overcoat layer mentioned above in paragraph (2) was repeated.

The crosslinked overcoat layer formed on the toner image was cut (incised) horizontally and vertically with a cutter at regular intervals of 1 mm to prepare 100 cut portions of the overcoat layer. A cellophane adhesive tape was attached to the cut portions, and the adhesive tape was pulled up. The adhesive tape was visually observed using a loupe to determine the ratio (N/100) of the number (N) of cut portions of the overcoat layer which are not adhered to the adhesive tape and remain on the toner image to the total number of cut portions (i.e., 100). The adhesiveness of the overcoat layer was graded as follows.

◎: The ratio (N/100) is 100/100. (Excellent)

○: The ratio (N/100) is from 80/100 to 99/100. (Good)

Δ: The ratio (N/100) is from 40/100 to 79/100. (Slightly bad)

X: The ratio (N/100) is from 0/100 to 39/100. (Bad)

The evaluation results are shown in Table 1 below.

Example 2

Preparation of Toners 2 and Developers 2

The procedure for preparation of the toners 1 and the developers 1 in Example 1 was repeated except that the microcrystalline wax was replaced with a mixture of a microcrystalline wax and a paraffin wax, which includes isoparaffins in an amount of 9% by weight, and has an average molecular weight of 520, to prepare K, Y, M and C toners 2 and K, Y, M and C developers 2. The toners have a circularity of 0.90 and a volume average particle diameter of 7 μm.

Preparation of Overcoat Layer Composition Liquid 2

The following components were mixed and agitated for 20 minutes at 60° C. to prepare a photo-crosslinkable overcoat layer composition liquid 2.

| | |
|---|---|
| Polyester acrylate oligomer (EBECRYL 846 from Daicel Cytec Co., Ltd., having a weight average molecular weight (MW) of 1,100) | 40 parts |
| Tripropylene glycol diacrylate | 30 parts |
| Acryloyl morphorine | 50 parts |
| Hydroquinone monomethyl ether (polymerization inhibitor) | 0.2 parts |
| Benzoin ethyl ether (photopolymerization initiator) | 8 parts |
| Triisopropanolamine (sensitizer) | 3 parts |

The procedure for evaluation in Example 1 was repeated except that the developers 1 and the overcoat layer composition liquid 1 were replaced with the developers 2 and the overcoat layer composition liquid 2, respectively.

The evaluation results are shown in Table 1 below.

Example 3

Preparation of Toners 3 and Developers 3

The procedure for preparation of the toners 1 and the developers 1 in Example 1 was repeated except that the microcrystalline wax was replaced with a mixture of a microcrystalline wax and a paraffin wax, which includes isoparaffins in an amount of 4% by weight, and has an average molecular weight of 550, to prepare K, Y, M and C toners 3 and K, Y, M and C developers 3.

The procedure for evaluation in Example 2 was repeated except that the developers 2 were replaced with the developers 3.

The evaluation results are shown in Table 1 below.

Example 4

Preparation of Toners 4 and Developers 4

The procedure for preparation of the toners 2 and the developers 2 in Example 2 was repeated except that the microcrystalline wax was replaced with a paraffin wax having an average molecular weight of 550 to prepare K, Y, M and C toners 4 and K, Y, M and C developers 4.

The procedure for evaluation in Example 2 was repeated except that the developers 2 were replaced with the developers 4.

The evaluation results are shown in Table 1 below.

Comparative Example 1

The procedure for preparation of the toners 4 and the developers 4 in Example 4 was repeated.

The procedure for evaluation in Example 4 was repeated except that the image forming apparatus (IMAGIO MP C7500 from Ricoh Co., Ltd.) was modified so that the image forming speed was decreased by 20%.

The evaluation results are shown in Table 1 below.

Comparative Example 2

The procedure for preparation of the toners 4 and the developers 4 was repeated.

The procedure for evaluation in Example 4 was repeated except that the image forming apparatus (IMAGIO MP C7500 from Ricoh Co., Ltd.) was modified so that the image forming speed is decreased by 25%, and the weight of each of the solid images is 0.5 g/m$^2$.

The evaluation results are shown in Table 1 below.

Comparative Example 3

Preparation of Toners 5 and Developers 5

The procedure for preparation of the toners 1 and the developers 1 in Example 1 was repeated except that the microcrystalline wax was replaced with 1.8 parts of a paraffin wax having an average molecular weight of 500 to prepare K, Y, M and C toners 5 and K, Y, M and C developers 5.

The procedure for evaluation in Example 2 was repeated except that the developers 2 were replaced with the developers 5.

As shown in Table 1 below, the overcoat layer has no repelled portion while having good adhesiveness with the toner images. However, the toner images were seriously damaged. When the fixing roller of the image forming apparatus was visually observed, a large number of melted toner streaks were adhered to the fixing roller.

Example 5

Preparation of Toners 6 and Developers 6

The procedure for preparation of the toners 1 and the developers 1 in Example 1 was repeated except that the microcrystalline wax was replaced with a mixture of a microcrystalline wax and a paraffin wax, which includes isoparaffins in an amount of 11% by weight and which has an average molecular weight of 480, to prepare K, Y, M and C toners 6 and K, Y, M and C developers 6.

The toners had a circularity of 0.91 and a volume average particle diameter of 7.8 μm.

Preparation of Overcoat Layer Composition Liquid 3

The following components were mixed and agitated for 20 minutes at 60° C. to prepare a photo-crosslinkable overcoat layer composition liquid 3.

| | |
|---|---|
| Urethane acrylate oligomer (EBECRYL 5129 from Daicel Cytec Co., Ltd., having a weight average molecular weight (MW) of 800) | 10 parts |
| Hexanediol diacrylate | 41 parts |
| Cyclohexyl acrylate | 10 parts |
| Ethylcarbitol acrylate | 80 parts |
| Hydroquinone monomethyl ether (polymerization inhibitor) | 0.3 parts |
| Benzyl(1,2-diphenylethanedione) (photopolymerization initiator) | 6 parts |

The procedure for evaluation in Example 1 was repeated except that the developers 1 and the overcoat layer composition liquid 1 were replaced with the developers 6 and the overcoat layer composition liquid 3, respectively.

The evaluation results are shown in Table 1 below.

Example 6

Preparation of Overcoat Layer Composition Liquid 4

The following components were mixed and agitated for 20 minutes at 60° C. to prepare a photo-crosslinkable overcoat layer composition liquid 4.

| | |
|---|---|
| Polyester acrylate oligomer (EBECRYL 1830 from Daicel Cytec Co., Ltd., having a weight average molecular weight (MW) of 1,500) | 60 parts |
| Diacrylate of ethylene oxide adduct of bisphenol A (V#700 from Osaka Organic Chemical Industry Ltd.) | 30 parts |
| 2-Ethylhexyl acrylate | 5 parts |
| 1,6-Hexanediol diacrylate | 20 parts |
| 2,6-Di-tert-butyl-p-cresol (BHT) (polymerization inhibitor) | 0.4 parts |
| IRGACURE 184 (photopolymerization initiator, from Ciba Specialty Chemical) | 9 parts |

The procedure for evaluation in Example 1 was repeated except that the overcoat layer composition liquid 1 was replaced with the overcoat layer composition liquid 4.

The evaluation results are shown in Table 1 below.

Example 7

Preparation of Overcoat Layer Composition Liquid 5

The procedure for preparation of the overcoat layer composition liquid 1 in Example 1 was repeated except that the added amount of the photo-crosslinkable varnish was changed from 75 parts to 70 parts, and 4.5 parts of a polyoxyethylene glycol alkyl ether serving as a surfactant was added to prepare a photo-crosslinkable overcoat layer composition liquid 5.

The procedure for evaluation in Example 1 was repeated except that the overcoat layer composition liquid 1 was replaced with the overcoat layer composition liquid 5.

The evaluation results are shown in Table 1 below.

Example 8

Preparation of Overcoat Layer Composition Liquid 6

The procedure for preparation of the overcoat layer composition liquid 4 in Example 6 was repeated except that the added amount of 2-ethylhexyl acrylate was changed from 5 parts to 3 parts, and 2 parts of sodium dialkyl sulfosuccinate serving as an anionic surfactant was added to prepare a photo-crosslinkable overcoat layer composition liquid 6.

The procedure for evaluation in Example 6 was repeated except that the overcoat layer composition liquid 4 was replaced with the overcoat layer composition liquid 6.

The evaluation results are shown in Table 1 below.

Example 9

Preparation of Toners 7

1. Preparation of Toner Component Solution/Dispersion 1-1. Synthesis of Unmodified Polyester (Low Molecular Weight Polyester)

The following components were contained in a reaction vessel equipped with a condenser, a stirrer, and a nitrogen feed pipe.

| | |
|---|---|
| Ethylene oxide (2 mole) adduct of bisphenol A | 67 parts |
| Propylene oxide (3 mole) adduct of bisphenol A | 84 parts |
| Terephthalic acid | 274 parts |
| Dibutyl tin oxide | 2 parts |

The mixture was subjected to a condensation reaction for 8 hours at 230° C. and normal pressure under a nitrogen gas flow. The reaction was further continued for 6 hours under a reduced pressure of from 10 mmHg to 15 mmHg (1,333 Pa to 2,000 Pa) to prepare an unmodified polyester.

The unmodified polyester had a number average molecular weight (Mn) of 2,200, a weight average molecular weight (Mw) of 5,700, and a glass transition temperature (Tg) of 56° C.

1-2. Preparation of Master Batch (MB)

The following components were mixed using a HENSCHEL MIXER mixer from Nippon Coke & Engineering Co., Ltd.

| | |
|---|---|
| Water | 1,000 parts |
| Carbon black (PRINTEX 35 from Degussa AG, having a DBP oil absorption of 42 ml/100 g, and a pH of 9.5) | 540 parts |
| Unmodified polyester prepared above | 1,200 parts |

The mixture was kneaded for 30 minutes at 150° C. using a two-roll mill, followed by roll cooling and pulverization using a pulverizer (from Hosokawa Micron Corp.). Thus, a master batch was prepared.

1-3. Synthesis of Prepolymer

The following components were contained in a reaction vessel equipped with a condenser, a stirrer, and a nitrogen feed pipe.

| | |
|---|---|
| Ethylene oxide (2 mole) adduct of bisphenol A | 682 parts |
| Propylene oxide (3 mole) adduct of bisphenol A | 81 parts |
| Terephthalic acid | 283 parts |
| Trimellitic anhydride | 22 parts |
| Dibutyl tin oxide | 2 parts |

The mixture was subjected to a condensation reaction for 8 hours at 230° C. and normal pressure under a nitrogen gas flow. The reaction was further continued for 5 hours under a reduced pressure of from 10 mmHg to 15 mmHg (1,333 Pa to 2,000 Pa) to prepare an intermediate polyester.

The intermediate polyester had a number average molecular weight (Mn) of 2,100, a weight average molecular weight (Mw) of 9,600, a glass transition temperature (Tg) of 55° C., an acid value of 0.5 mgKOH/g, and a hydroxyl value of 49 mgKOH/g.

Next, the following components were contained in a reaction vessel equipped with a condenser, a stirrer, and a nitrogen feed pipe.

| | |
|---|---|
| Intermediate polyester prepared above | 411 parts |
| Isophorone diisocyanate | 89 parts |
| Ethyl acetate | 500 parts |

The mixture was subjected to a reaction for 5 hours at 100° C. under a nitrogen gas flow to prepare a prepolymer (i.e., a modified polyester capable of reacting with a compound having an active hydrogen group).

The thus prepared prepolymer included free isocyanate in an amount of 1.60% by weight, and had a solid content of 50% by weight which was measured by heating the prepolymer for 45 minutes at 150° C.

1-4. Synthesis of Ketimine Compound (i.e., Compound Having an Active Hydrogen Group)

Thirty (30) parts of isophoronediamine and 70 parts of methyl ethyl ketone were contained in a reaction vessel equipped with a stirrer and a thermometer, and the mixture was subjected to a reaction for 5 hours at 50° C. to prepare a ketimine compound serving as a compound having an active hydrogen group.

The ketimine compound had an amine value of 423 mgKOH/g.

1-5. Synthesis of Styrene-Acrylic Copolymer

After 300 parts of ethyl acetate was fed into a reaction vessel equipped with a condenser, a stirrer, and a nitrogen feed pipe, 300 parts of a styrene-acrylic monomer mixture (styrene/2-ethylhexyl acrylate/acrylic acid/2-hydroxyethyl acrylate=75/15/5/5 by weight), and 10 parts of azobisisobutyronitrile were fed into the reaction vessel, and the mixture was reacted for 15 hours at 60° C.

Next, 200 parts of methanol was added to the reaction product, and the mixture was agitated for one hour. After the supernatant of the mixture was removed therefrom, the residue was dried to obtain a styrene-acrylic copolymer.

1-6. Preparation of Toner Component Solution/Dispersion

The following components were fed into a beaker.

| | |
|---|---|
| Prepolymer prepared above | 10 parts |
| Unmodified polyester prepared above | 60 parts |
| Ethyl acetate | 130 parts |
| Styrene-acrylic copolymer prepared above | 30 parts |

The mixture was agitated to prepare a solution.

The following components were added to the mixture.

| | |
|---|---|
| Microcrystalline wax (including isoparaffins in an amount of 15% by weight, and having an average molecular weight of 650) | 10 parts |
| Master batch prepared above | 10 parts |

The mixture was subjected to bead-milling using ULTRAVISCO MILL from AIMEX Co., Ltd. The milling conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Next, 2.7 parts of the ketimine compound prepared above was added thereto to prepare a toner component solution/dispersion.

2. Preparation of Aqueous Phase Liquid

The following components were mixed and agitated to prepare an aqueous phase liquid.

| | |
|---|---|
| Ion exchange water | 306 parts |
| 10% by weight aqueous suspension of tricalcium phosphate | 265 parts |
| Sodium dodecyl benzene sulfonate | 0.2 parts |

3. Preparation of Emulsion/Dispersion

Initially, 150 parts of the above-prepared aqueous phase liquid was fed to a container, and was agitated by a TK HOMOMIXER mixer (from Tokushu Kika Kogyo Co., Ltd.), whose rotor was rotated at 12,000 rpm. In addition, 100 parts of the above-prepared toner component solution/dispersion was added to the container, and the mixture was agitated for 10 minutes by the mixer. Thus, an emulsion/dispersion (hereinafter referred to as an emulsion slurry) was prepared.

4. Removal of Organic Solvent

Initially, 100 parts of the above-prepared emulsion slurry was fed into a flask equipped with a stirrer and a thermometer, and was agitated for 12 hours at 30° C. by the stirrer, which was rotated at a peripheral speed of 20 m/min. Thus, a dispersion slurry was prepared.

5. Washing and Drying

After, 100 parts of the above-prepared dispersion slurry was subjected to filtration under reduced pressure, 100 parts of ion exchange water was added to the resultant wet cake, and the mixture was agitated for 10 minutes by a TK HOMOMIXER mixer (from Tokushu Kika Kogyo Co., Ltd.), whose rotor was rotated at 12,000 rpm, followed by filtering.

The resultant wet cake was mixed with 300 parts of ion-exchange water, and the mixture was agitated for 10 minutes with the TK HOMOMIXER mixer, which was rotated at a revolution of 12,000 rpm, followed by filtering. This washing treatment was repeated twice. Thus, a wet cake (a) was prepared.

The thus prepared wet cake (a) was mixed with 20 parts of a 10% aqueous solution of sodium hydroxide, and the mixture was agitated for 30 minutes with the TK HOMOMIXER mixer, whose rotor was rotated at a revolution of 12,000 rpm, followed by filtering under a reduced pressure. Thus, a wet cake (b) was prepared.

The wet cake (b) was mixed with 300 parts of ion-exchange water, and the mixture was agitated for 10 minutes with the TK HOMOMIXER mixer, whose rotor was rotated at a revolution of 12,000 rpm, followed by filtering. This washing treatment was repeated three times. Thus, a wet cake (c) was prepared.

The wet cake (c) was mixed with 20 parts of a 10% hydrochloric acid, and the mixture was agitated for 10 minutes with the TK HOMOMIXER mixer, whose rotor was rotated at a revolution of 12,000 rpm, followed by filtering. Thus, a wet cake (d) was prepared.

The wet cake (d) was mixed with 300 parts of ion-exchange water and the mixture was agitated for 10 minutes with the TK HOMOMIXER mixer, whose rotor was rotated at a revolution of 12,000 rpm, followed by filtering. This washing treatment was repeated twice. Thus, a final wet cake was prepared.

The final wet cake was dried for 48 hours at 45° C. using a circulating air drier, followed by filtering using a screen having openings of 75 μm. Thus, toner particles (i.e., mother toner) were prepared.

6. Addition of External Additive

The following components were mixed using a HENSCHEL MIXER mixer to prepare a black toner 7.

| | |
|---|---|
| Toner particles prepared above | 100 parts |
| Hydrophobized silica (average particle diameter of 100 nm) | 0.6 parts |
| Titanium oxide (average particle diameter of 20 nm) | 1.0 part |
| Hydrophobized silica (average particle diameter of 15 nm) | 0.8 parts |

The black toner 7 had an average circularity of 0.940, and a volume average particle diameter of 5.7 μm.

In addition, the procedure for preparation of the black toner 7 was repeated except that the carbon black serving as a colorant was replaced with Pigment Yellow 17, Pigment Red 57, or Pigment Blue 15 to prepare yellow, magenta and cyan toners 7.

Preparation of Developers 7

Preparation of Carrier

The following components were mixed for 10 minutes using a HOMOMIXER mixer to prepare a cover layer coating liquid.

| | |
|---|---|
| 50% Toluene solution of acrylic resin (Copolymer of cyclohexyl methacrylate/methyl methacrylate = 80/20 by weight synthesized from monomers manufactured by Mitsubishi Rayon Co., Ltd.) | 21.0 parts |
| Guanamine solution (SUPER BECKAMINE TD-126 from DIC Corp., having a solid content of 70% by weight) | 6.4 parts |
| Particulate alumina (SUMICORUNDUM AA-03 from Sumitomo Chemical Co., Ltd., having an average particle diameter of 0.3 μm, and volume resistivity of $10^{14}$ Ω · cm) | 7.6 parts |
| 65% Silicone resin solution (SR2410 from Dow Corning Toray Silicone Co., Ltd., having a solid content of 23% by weight) | 65.0 parts |
| Amino silane (SH6020 from Dow Corning Toray Silicone Co., Ltd., having a solid content of 100%) | 1.0 part |
| Toluene | 60 parts |
| Butyl cellosolve | 60 parts |

A calcined ferrite powder, which has a formula $(MgO)_{1.8}(MnO)_{49.5}(Fe_2O_3)_{48.0}$ and an average particle diameter of 35 μm and which serves as a core material of carrier, was coated with the above-prepared cover layer coating liquid using a SPIRA COTA from Okada Seiko Co., Ltd. to prepare a cover layer having a thickness of 0.15 μm on the core material. The thus surface-treated core material was allowed to settle for one hour in an electric furnace heated to 150° C. After being cooled, the surface-treated core material was sieved using a screen having openings of 106 μm. Thus, a coated carrier having a weight average particle diameter of 35 μm was prepared.

Preparation of Developers 7

The following components were mixed and agitated using a TURBULA mixer in which a container makes rolling motion.

| | |
|---|---|
| Coated carrier prepared above | 100 parts |
| Each of K, Y, M and C toners 7 prepared above | 7 parts |

Thus, K, Y, M and C developers 7 were prepared.

The procedure for evaluation in Example 1 was repeated except that the developers 1 were replaced with the developers 7.

The evaluation results are shown in Table 1 below.

Example 10

The procedure for evaluation in Example 9 was repeated except that the image forming apparatus (IMAGIO MP C7500 from Ricoh Co., Ltd.) was modified so that the image forming speed was decreased by 20%.

The evaluation results are shown in Table 1 below.

TABLE 1

| | Toner | | Ratio | Overcoat layer composition liquid | | | Evaluation | | |
|---|---|---|---|---|---|---|---|---|---|
| | | | | | Viscocity | | | | |
| | No. | wax | Ab/Aa | No. | (mPa · s) | ΔE* | WET* | ADH** | Others |
| Ex. 1 | 1 | MW | 3.8 | 1 | 210 | 5.9 | ◎ | ◎ | |
| Ex. 2 | 2 | MW/PW | 5.5 | 2 | 440 | 4.6 | ◎ | ◎ | |
| Ex. 3 | 3 | MW/PW | 6.6 | 2 | 440 | 4.6 | ◎ | ◎ | |
| Ex. 4 | 4 | PW | 6.9 | 2 | 440 | 4.6 | ○ | ○ | |
| Comp. Ex. 1 | 4 | PW | 7.2 | 2 | 440 | 4.6 | Δ | Δ | |
| Comp. Ex. 2 | 4 | PW | 7.7 | 2 | 440 | 4.6 | X | X | |
| Comp. Ex. 3 | 5 | PW | 2.8 | 2 | 440 | 4.6 | ◎ | ◎ | Damaged images*** |
| Ex. 5 | 6 | MW/PW | 3.3 | 3 | 20 | 27.8 | ◎ | ◎ | |
| Ex. 6 | 1 | MW | 3.8 | 4 | 750 | 3.5 | ◎ | ○ | |
| Ex. 7 | 1 | MW | 3.8 | 5 | 185 | 6.2 | ◎ | ◎ | |
| Ex. 8 | 1 | MW | 3.8 | 6 | 420 | 5.0 | ◎ | ○ | |
| Ex. 9 | 7 | MW | 4.6 | 1 | 210 | 5.4 | ◎ | ◎ | |
| Ex. 10 | 7 | MW | 5.9 | 1 | 210 | 5.4 | ◎ | ◎ | |

WET*: Wettability of overcoat layer composition liquid
ADH**: Adhesiveness of overcoat layer
Damaged images***: The images were seriously damaged.
MW: Microcrystalline wax
PW: Paraffin wax

Example 11

Preparation of Toners 11 and Developers 11

The procedure for preparation of the toners 1 and the developers 1 in Example 1 was repeated to prepare toners 11 and developers 11.

Preparation of Overcoat Layer Composition Liquid 11

The following components were fed into a beaker.

| | |
|---|---|
| Pentaerythritol tetraacrylate | 9 parts |
| Ethoxydiethylene glycol | 2 parts |
| Trimethylolpropane triacrylate | 30 parts |
| Hydroquinone (polymerization inhibitor) | 0.3 parts |

After the mixture was hated to 120° C. while agitated, 50 parts of diallyl phthalate prepolymer (DAISO DAP 100 from Daiso Co., Ltd.) was added to the mixture to be dissolved therein. In addition, a dispersion in which 2 parts of aluminum isopropylate is dispersed in 2 parts of toluene was gradually added thereto, and the mixture was agitated for 20 minutes at 110° C. to remove toluene from the mixture. Thus, a photo-crosslinkable varnish was prepared.

In addition, the following components were mixed.

| | |
|---|---|
| Photo-crosslinkable varnish prepared above | 75 parts |
| 1,6-Hexanediol acrylate | 60 parts |
| Benzophenone (Photopolymerization initiator) | 10 parts |
| p-Dimethylaminoacetophenone | 5 parts |
| Phenylglycol monoacrylate (viscosity modifier) | 10 parts |

The mixture was kneaded by a 3-roll mill to prepare a photo-crosslinkable overcoat layer component liquid 11.

The procedure for evaluation in Example 1 was repeated except that the developers 1 and the overcoat layer composition liquid 1 was replaced with the developers 11 and the overcoat layer composition liquid 11, respectively. In this regard, instead of the ratio Ab/Aa, the ratio Ab'/Aa' was measured under the conditions mentioned above.

The evaluation results are shown in Table 2 below.

Example 12

Preparation of Toners 12 and Developers 12

The procedure for preparation of the toners 1 and the developers 1 in Example 1 was repeated except that the microcrystalline wax was replaced with a mixture of a microcrystalline wax and a paraffin wax, which includes isoparaffins in an amount of 9% by weight, and has an average molecular weight of 520 to prepare K, Y, M and C toners 12 and K, Y, M and C developers 12. The toners have a circularity of 0.91 and a volume average particle diameter of 7 μm.

Preparation of Overcoat Layer Composition Liquid 12

The following components were mixed and agitated for 20 minutes at 60° C. to prepare a photo-crosslinkable overcoat layer composition liquid 12.

| | |
|---|---|
| Polyester acrylate oligomer (EBECRYL 846 from Daicel Cytec Co., Ltd., having a weight average molecular weight (MW) of 1,100) | 40 parts |
| Ethoxydiethylene glycol | 2 parts |
| Tripropylene glycol diacrylate | 30 parts |
| Acryloyl morphorine | 50 parts |
| Hydroquinone monomethyl ether (polymerization inhibitor) | 0.2 parts |
| Benzoin ethyl ether (photopolymerization initiator) | 8 parts |
| Triisopropanolamine (sensitizer) | 3 parts |

The procedure for evaluation in Example 11 was repeated except that the developers (i.e., developers 1) and the overcoat layer composition liquid 11 were replaced with the developers 12 and the overcoat layer composition liquid 12, respectively.

The evaluation results are shown in Table 2 below.

Example 13

Preparation of Toners 13 and Developers 13

The procedure for preparation of the toners 11 and the developers 11 in Example 11 was repeated except that the microcrystalline wax was replaced with a mixture of a microcrystalline wax and a paraffin wax, which includes isoparaffins in an amount of 4% by weight, and has an average molecular weight of 550, to prepare K, Y, M and C toners 13 and K, Y, M and C developers 13.

The procedure for evaluation in Example 12 was repeated except that the developers 12 were replaced with the developers 13.

The evaluation results are shown in Table 2 below.

Example 14

Preparation of Toners 14 and Developers 14

The procedure for preparation of the toners 12 and the developers 12 in Example 12 was repeated except that the microcrystalline wax was replaced with a paraffin wax, which has an average molecular weight of 500 to prepare K, Y, M and C toners 14 and K, Y, M and C developers 14.

The procedure for evaluation in Example 12 was repeated except that the developers 12 were replaced with the developers 14.

The evaluation results are shown in Table 2 below.

Comparative Example 11

The procedure for evaluation in Example 14 was repeated except that the image forming apparatus (IMAGIO MP C7500 from Ricoh Co., Ltd.) was modified so that the image forming speed was decreased by 20%.

The evaluation results are shown in Table 2 below.

Comparative Example 12

The procedure for evaluation in Example 14 was repeated except that the image forming apparatus (IMAGIO MP C7500 from Ricoh Co., Ltd.) was modified so that the image forming speed was decreased by 25% and the weight of the solid images was changed to 0.5 mg/cm$^2$.

The evaluation results are shown in Table 2 below.

Comparative Example 13

Preparation of Toners 15 and Developers 15

The procedure for preparation of the toners 11 and the developers 11 in Example 11 was repeated except that the microcrystalline wax was replaced with 1.8 parts of a paraffin wax having a weight average molecular weight of 500 to prepare K, Y, M and C toners 15 and K, Y, M and C developers 15.

The procedure for evaluation in Example 12 was repeated except that the developers 12 were replaced with the developers 15.

As shown in Table 2 below, the overcoat layer has no repelled portion while having good adhesiveness with the toner images. However, the toner images were seriously damaged. When the fixing roller of the image forming apparatus was visually observed, a large number of melted toner streaks were adhered to the fixing roller.

Example 15

Preparation of Toners 16 and Developers 16

The procedure for preparation of the toners 11 and the developers 11 in Example 11 was repeated except that the microcrystalline wax was replaced with a mixture of a microcrystalline wax and a paraffin wax, which includes isoparaffins in an amount of 11% by weight and which has an average molecular weight of 480, to prepare K, Y, M and C toners 16 and K, Y, M and C developers 16.

The toners had a circularity of 0.91 and a volume average particle diameter of 7.8 μm.

Preparation of Overcoat Layer Composition Liquid 13

The following components were mixed and agitated for 20 minutes at 60° C. to prepare a photo-crosslinkable overcoat layer composition liquid 13.

| | |
|---|---|
| Urethane acrylate oligomer (EBECRYL 5129 from Daicel Cytec Co., Ltd., having a weight average molecular weight (MW) of 800) | 10 parts |
| Hexanediol diacrylate | 41 parts |
| Cyclohexyl acrylate | 10 parts |
| Ethylcarbitol acrylate | 80 parts |
| Ethoxydiethylene glycol | 2 parts |
| Hydroquinone monomethyl ether (polymerization inhibitor) | 0.3 parts |
| Benzyl(1,2-diphenylethanedione) (photopolymerization initiator) | 6 parts |

The procedure for evaluation in Example 11 was repeated except that the developers (developers 1) and the overcoat layer composition liquid 11 were replaced with the developers 16 and the overcoat layer composition liquid 13, respectively.

The evaluation results are shown in Table 2 below.

Example 16

Preparation of Overcoat Layer Composition Liquid 14

The following components were mixed and agitated for 20 minutes at 60° C. to prepare a photo-crosslinkable overcoat layer composition liquid 14.

| | |
|---|---|
| Polyester acrylate oligomer (EBECRYL 1830 from Daicel Cytec Co., Ltd., having a weight average molecular weight (MW) of 1,500) | 60 parts |
| Diacrylate of ethylene oxide adduct of bisphenol A (V#700 from Osaka Organic Chemical Industry Ltd.) | 30 parts |
| 2-Ethylhexyl acrylate | 5 parts |
| 1,6-Hexanediol diacrylate | 20 parts |
| Ethoxydiethylene glycol | 2 parts |
| 2,6-Di-tert-butyl-p-cresol (BHT) (polymerization inhibitor) | 0.4 parts |
| IRGACURE 184 (photopolymerization initiator, from Ciba Specialty Chemical) | 9 parts |

The procedure for evaluation in Example 11 was repeated except that the overcoat layer composition liquid 11 was replaced with the overcoat layer composition liquid 14.

The evaluation results are shown in Table 2 below.

Example 17

Preparation of Overcoat Layer Composition Liquid 15

The procedure for preparation of the overcoat layer composition liquid 11 in Example 11 was repeated except that the added amount of the photo-crosslinkable varnish was changed from 75 parts to 70 parts, and 4.5 parts of polyoxyethylene glycol alkyl ether serving as a surfactant was added to prepare a photo-crosslinkable overcoat layer composition liquid 15.

The procedure for evaluation in Example 11 was repeated except that the overcoat layer composition liquid 11 was replaced with the overcoat layer composition liquid 15.

The evaluation results are shown in Table 2 below.

Example 18

Preparation of Overcoat Layer Composition Liquid 16

The procedure for preparation of the overcoat layer composition liquid 14 in Example 16 was repeated except that the added amount of 2-ethylhexyl acrylate was changed from 5 parts to 3 parts, and 2 parts of sodium dialkyl sulfosuccinate serving as an anionic surfactant was added to prepare a photo-crosslinkable overcoat layer composition liquid 16.

The procedure for evaluation in Example 16 was repeated except that the overcoat layer composition liquid 14 was replaced with the overcoat layer composition liquid 16.

The evaluation results are shown in Table 2 below.

Example 19

The procedure for evaluation in Example 11 was repeated except that the developers 11 were replaced with the developers 7.

The evaluation results are shown in Table 2 below.

Example 20

The procedure for evaluation in Example 19 was repeated except that the image forming apparatus (IMAGIO MP C7500 from Ricoh Co., Ltd.) was modified so that the image forming speed was decreased by 20%.

The evaluation results are shown in Table 2 below.

TABLE 2

| | Toner | | | Overcoat layer composition liquid | | | Evaluation | | |
|---|---|---|---|---|---|---|---|---|---|
| | No. | wax | Ab'/Aa' | No. | Viscocity (mPa · s) | ΔE* | WET* | ADH** | Others |
| Ex. 11 | 11 | MW | 0.0053 | 11 | 200 | 5.8 | ◎ | ◎ | |
| Ex. 12 | 12 | MW/PW | 0.0091 | 12 | 460 | 4.6 | ◎ | ◎ | |
| Ex. 13 | 13 | MW/PW | 0.0115 | 12 | 460 | 4.6 | ◎ | ◎ | |
| Ex. 14 | 14 | PW | 0.0135 | 12 | 460 | 4.6 | ○ | ○ | |
| Comp. Ex. 11 | 14 | PW | 0.0144 | 12 | 460 | 4.6 | Δ | Δ | |
| Comp. Ex. 12 | 14 | PW | 0.0159 | 12 | 460 | 4.6 | X | X | |
| Comp. Ex. 13 | 15 | PW | 0.0036 | 12 | 460 | 4.6 | ◎ | ◎ | Damaged images*** |
| Ex. 15 | 16 | MW/PW | 0.0042 | 13 | 20 | 27.8 | ◎ | ◎ | |
| Ex. 16 | 11 | MW | 0.0051 | 14 | 740 | 3.5 | ◎ | ○ | |
| Ex. 17 | 11 | MW | 0.0051 | 15 | 180 | 6.2 | ◎ | ◎ | |
| Ex. 18 | 11 | MW | 0.0051 | 16 | 410 | 5.0 | ◎ | ○ | |
| Ex. 19 | 7 | MW | 0.0075 | 11 | 210 | 5.3 | ◎ | ◎ | |
| Ex. 20 | 7 | MW | 0.0097 | 11 | 210 | 5.3 | ◎ | ◎ | |

WET*: Wettability of overcoat layer composition liquid
ADH**: Adhesiveness of overcoat layer
Damaged images***: The images were seriously damaged.
MW: Microcrystalline wax
PW: Paraffin wax According to Examples 1-20 and Comparative Examples 1-3 and 11-13, the following can be said.

Specifically, by forming an overcoat layer on toner image, which are formed by oil-less fixing and which bear thereon a proper amount of wax, images having good durability and expensive-looking can be provided.

In addition, by forming an image using an image forming apparatus which can form toner images bearing thereon a proper amount of wax using oil-less fixing, and then forming an overcoat layer thereon, images having good durability and expensive-looking can be provided.

Further, by crosslinking an overcoat layer using light or electron beams, images having good durability and expensive-looking can be provided with high productivity.

Furthermore, by enhancing the affinity of components constituting an overcoat layer for toner images fixed by oil-less fixing, images having good durability and expensive-looking can be provided.

Furthermore, by including a surfactant in an overcoat layer composition liquid, the overcoat layer composition liquid can be evenly applied on toner images fixed by oil-less fixing, thereby making it possible to provide images having good durability and expensive-looking.

Additional modifications and variations of the present invention are possible in light of the above teachings. It is therefore to be understood that within the scope of the appended claims the invention may be practiced other than as specifically described herein.

What is claimed is:

1. An image forming method comprising:

forming an image of a toner including a wax on a recording medium using electrophotography;

fixing the toner image to the recording medium using an oil-less fixing device which fixes the toner image using a fixing member without applying a release agent to the fixing member; and then forming an overcoat layer on the fixed toner image, wherein when a portion of the fixed toner image having a heaviest toner weight in the fixed toner image is subjected to an Attenuated Total Reflectance Fourier Transform Infrared Spectroscopic (ATR FT-IR) analysis to obtain a spectrum of the portion of the fixed toner image, the following relationship (1) or (2) is satisfied:

| | |
|---|---|
| $3.0 \leq Ab/Aa \leq 7.0$ | (1), or |
| $0.004 \leq Ab'/Aa' \leq 0.014$ | (2), |

wherein Aa represents an area of a peak of the spectrum present in a range of from 2896 $cm^{-1}$ to 2943 $cm^{-1}$, Ab represents an area of a peak of the spectrum present in a range of from 2946 $cm^{-1}$ to 2979 $cm^{-1}$, Aa' represents an area of a peak of the spectrum present in a range of from 791 $cm^{-1}$ to 860 $cm^{-1}$, and Ab' represents an area of a peak of the spectrum present in a range of from 2834 $cm^{-1}$ to 2862 $cm^{-1}$, and wherein the ATR FT-IR analysis is performed under the following conditions:

(1) crystal used is Ge;

(2) incident angle is 45°;

(3) number of reflectance is one; and (4) the area Aa of the peak in the range of from 2896 $cm^{-1}$ to 2943 $cm^{-1}$ is defined as an area of a portion of the peak above a base line, which is a line connecting a point of the peak at 2896 $cm^{-1}$ with a point of the peak at 2943 $cm^{-1}$; the area Ab of the peak in the range of from 2946 $cm^{-1}$ to 2979 $cm^{-1}$ is defined as an area of a portion of the peak above a base line, which is a line connecting a point of the peak at 2946 $cm^{-1}$ with a point of the peak at 2979 $cm^{-1}$; the area Aa' of the peak in the range of from 791 $cm^{-1}$ to 860 $cm^{-1}$ is defined as an area of a portion of the peak above a base line, which is a line connecting a point of the peak at 791 $cm^{-1}$ with a point of the peak at 860 $cm^{-1}$; and the area Ab' of the peak in the range of from 2834 $cm^{-1}$ to 2862 $cm^{-1}$ is defined as an area of a portion of the peak above a base line, which is a line connecting a point of the peak at 2834 $cm^{-1}$ with a point of the peak at 2862 $cm^{-1}$, wherein forming the overcoat layer comprises applying an overcoat layer composition liquid on the fixed toner image; and irradiating the applied overcoat layer composition liquid with light or electron beams to form a crosslinked overcoat layer on the fixed toner image, and wherein when the overcoat layer composition liquid is dropped from a point 10 mm above the fixed toner image in an amount of 0.3 to 0.5 $mg/cm^2$ and the overcoat layer composition liquid is removed from the fixed toner image ten seconds later, a color difference $\Delta E^*$ between the fixed toner image before dropping the overcoat layer composition liquid and the fixed toner image after dropping the overcoat layer composition liquid and removing the overcoat layer composition liquid is from 3 to 30.

2. The image forming method according to claim 1, wherein the toner image forming includes:

forming a color toner image of a test chart No. 4 of ISO/IEC 15775:1999 using yellow, magenta, cyan and black toners, wherein a portion of a fixed red toner image having a highest image density, a portion of a fixed blue toner image having a highest image density, and a portion of a fixed green toner image having a highest image density are subjected to the ATR FT-IR analysis to obtain three data of each of the ratios Ab/Aa and Ab'/Aa', and wherein a highest datum among the three data of the ratio Ab/Aa falls in the range of from 3.0 to 7.0 or a highest datum among the three data of the ratio Ab'/Aa' falls in the range of from 0.004 to 0.014.

3. The image forming method according to claim 1, wherein the overcoat layer composition liquid has a viscosity of from 10 mP·s to 800 mP·s.

4. The image forming method according to claim 1, wherein the overcoat layer composition liquid includes a surfactant.

5. The image forming method according to claim 1, wherein the wax includes a microcrystalline wax, and wherein the toner further includes a binder resin including a polyester.

* * * * *